US011832724B2

(12) United States Patent
Milligan et al.

(10) Patent No.: US 11,832,724 B2
(45) Date of Patent: Dec. 5, 2023

(54) ROTATIONAL BAR FOR DRAWER SLIDE LATCH OPERATION

(71) Applicants: Chuck Milligan, Santa Fe Springs, CA (US); Talia Minear, Santa Fe Springs, CA (US)

(72) Inventors: Chuck Milligan, Santa Fe Springs, CA (US); Talia Minear, Santa Fe Springs, CA (US)

(73) Assignee: Accuride International Inc., Santa Fe Springs, CA (US)

( * ) Notice: Subject to any disclaimer, the term of this patent is extended or adjusted under 35 U.S.C. 154(b) by 0 days.

(21) Appl. No.: 17/148,542

(22) Filed: Jan. 13, 2021

(65) Prior Publication Data

US 2021/0212463 A1 Jul. 15, 2021

Related U.S. Application Data

(60) Provisional application No. 62/960,486, filed on Jan. 13, 2020.

(51) Int. Cl.
*A47B 88/473* (2017.01)
*A47B 88/493* (2017.01)

(52) U.S. Cl.
CPC ..... *A47B 88/473* (2017.01); *A47B 88/493* (2017.01); *A47B 2210/0018* (2013.01)

(58) Field of Classification Search
CPC ..... A47B 88/473; A47B 88/50; A47B 88/53; A47B 88/423; A47B 88/427; A47B 2095/024; A47B 2210/0018
See application file for complete search history.

(56) References Cited

U.S. PATENT DOCUMENTS

| | | | | |
|---|---|---|---|---|
| 4,749,242 | A | 6/1988 | Rechberg | |
| 4,947,661 | A | 8/1990 | Yoshida | |
| 5,292,191 | A | 3/1994 | Slivon | |
| 5,868,478 | A | 2/1999 | Yemini | |
| 6,375,235 | B1 | 4/2002 | Mehmen | |
| 6,431,615 | B1 * | 8/2002 | Bastian | E05C 3/165 292/121 |
| 6,527,353 | B1 * | 3/2003 | Bradfish | A47B 88/944 312/333 |
| 6,547,289 | B1 * | 4/2003 | Greenheck | E05B 65/46 292/200 |

(Continued)

FOREIGN PATENT DOCUMENTS

| | | | |
|---|---|---|---|
| CN | 108868381 | A | 11/2018 |
| JP | 2009-219767 | A | 10/2009 |

OTHER PUBLICATIONS

International Search Report on related PCT Application No. PCT/US2021/013331 from International Searching Authority (KIPO) dated Apr. 29, 2021.

(Continued)

*Primary Examiner* — Hanh V Tran
(74) *Attorney, Agent, or Firm* — KOS IP Law LLP

(57) ABSTRACT

A rotating bar may be used to unlatch a drawer of a cabinet. In some embodiments a drawer slide used to extendably mount the drawer within the cabinet includes a latch comprised of a tab coupled to an inner member and a catch to receive the tab on an outer member. The tab may be part of a release lever, which may be actuated by an arm coupled to the rotating bar, to release the latch.

15 Claims, 37 Drawing Sheets

(56) References Cited

U.S. PATENT DOCUMENTS

| | | | | |
|---|---|---|---|---|
| 6,805,418 | B2 | 10/2004 | Milligan | |
| 6,817,685 | B2 | 11/2004 | Lammens | |
| 6,851,286 | B2 * | 2/2005 | Dube | E05C 1/14 292/336.3 |
| D535,551 | S | 1/2007 | Milligan | |
| 8,317,278 | B2 * | 11/2012 | Enos | A47B 88/493 312/334.47 |
| 3,608,261 | A1 | 12/2013 | Retchloff | |
| 9,010,830 | B2 * | 4/2015 | Hanley | B60R 11/00 296/24.44 |
| 9,233,647 | B1 * | 1/2016 | Hanley | B60R 11/06 |
| 10,004,331 | B2 * | 6/2018 | Jeffries | B21C 23/142 |
| 10,172,452 | B2 * | 1/2019 | Hanley | B60P 3/007 |
| 10,231,540 | B1 * | 3/2019 | Hong | E05B 65/46 |
| 10,362,870 | B1 * | 7/2019 | Smith | A47B 88/407 |
| 10,455,937 | B2 | 10/2019 | Jeffries | |
| 10,641,010 | B2 * | 5/2020 | Sonney | A47B 88/944 |
| 2001/0017509 | A1 * | 8/2001 | Hallsten | E05B 65/46 312/333 |
| 2002/0021061 | A1 | 2/2002 | Ammens | |
| 2003/0132687 | A1 * | 7/2003 | Morris | E05B 65/46 312/333 |
| 2004/0020248 | A1 | 2/2004 | Dube et al. | |
| 2005/0218760 | A1 | 10/2005 | Cheng | |
| 2007/0241651 | A1 | 10/2007 | Burgess, III et al. | |
| 2009/0102333 | A1 * | 4/2009 | Weng | A47B 95/02 292/300 |
| 2011/0121701 | A1 | 5/2011 | Chang | |
| 2014/0339974 | A1 * | 11/2014 | Gill | B25H 3/028 312/333 |
| 2015/0061483 | A1 * | 3/2015 | Liu | E05C 3/14 312/332.1 |
| 2015/0327676 | A1 * | 11/2015 | Chang | A47B 88/57 312/319.1 |
| 2016/0002962 | A1 | 1/2016 | Grela | |
| 2017/0150815 | A1 * | 6/2017 | Zhang | E05C 3/14 |
| 2018/0014638 | A1 * | 1/2018 | Hanley | A47B 88/50 |
| 2018/0279781 | A1 * | 10/2018 | Jeffries | A47B 95/02 |
| 2018/0320422 | A1 * | 11/2018 | Sharp | E05C 1/14 |
| 2019/0003219 | A1 * | 1/2019 | Doerflinger | E05B 65/46 |
| 2019/0231071 | A1 | 8/2019 | Smith | |
| 2019/0352938 | A1 * | 11/2019 | Sonney | E05B 65/46 |

OTHER PUBLICATIONS

Written Opinion on related PCT Application No. PCT/US2021/013331 from International Searching Authority (KIPO) dated Apr. 29, 2021.

Accuride Model 9308 Product Bulletin, Sell Sheet, and User Guide, Oct. 2003 (6 pages).

Statement Regarding Accuride 9308 Slide.

Office Action for related Chinese Patent Application No. 202180014837 dated Jul. 12, 2023.

* cited by examiner

ROTATIONAL BAR FOR DRAWER SLIDE LATCH OPERATION

CROSS REFERENCE TO RELATED APPLICATION

This application claims the benefit of the filing date of U.S. Provisional Patent Application No. 62/960,486, filed on Jan. 13, 2020, the disclosure of which is incorporated by reference herein.

BACKGROUND OF THE INVENTION

The present invention relates generally to cabinets, and more particularly to drawer cabinet latching systems.

Cabinets are often used to hold a variety of items in a convenient manner, with drawers of the cabinet extensible from the cabinet to allow for easy access to contents held by the drawers. At times, however, avoidance of inadvertent opening of the drawers may be desired.

BRIEF SUMMARY OF THE INVENTION

Some embodiments provide a latch for a drawer and a rotating bar for use in unlatching the latch. Some embodiments provide a drawer slide latch and release mechanism, comprising: a release lever pivotably mounted to a web of an inner member of a drawer slide, the release lever including a tab for engagement in a catch of an outer member of the drawer slide; and a rotating bar coupled to an arm, the arm positioned to engage the release lever on rotation of the rotating bar. In some embodiments the latch latches together an outer member and an inner member of a drawer slide, the outer member for coupling to a cabinet and the inner member for coupling to a drawer of the cabinet. In some embodiments an extending arm rotates with the rotating bar, with the extending arm dimensioned to contact a release lever on rotation of the rotating bar. In some embodiments the release lever is mounted to the inner member, with the release lever having a tab for engagement with a catch of the outer member. In some embodiments the catch is formed of a cutout in a web of the outer member. In some embodiments the tab of the release lever is positionable within the catch with the release lever in a first position, and the tab of the release lever is positioned free of the catch the release lever in a second position, different than the first position. In some embodiments the release lever is normally biased by a spring to the first position.

In some embodiments the rotating bar is mounted horizontally within end caps on a front face of the drawer. In some embodiments the extending arm is within a volume defined by a one of the end caps. In some embodiments the release lever extends forward of the front face of the drawer, and also into the volume defined by the one of the end caps. In some embodiments the extending arm extends from the rotating bar. In some embodiments the extending arm is fixedly coupled to the rotating bar. In some embodiments the end cap includes an interior stop surface for stopping rotation of the extending arm.

These and other aspects of the invention are more fully comprehended upon review of this disclosure.

DETAILED DESCRIPTION

Figure 1:
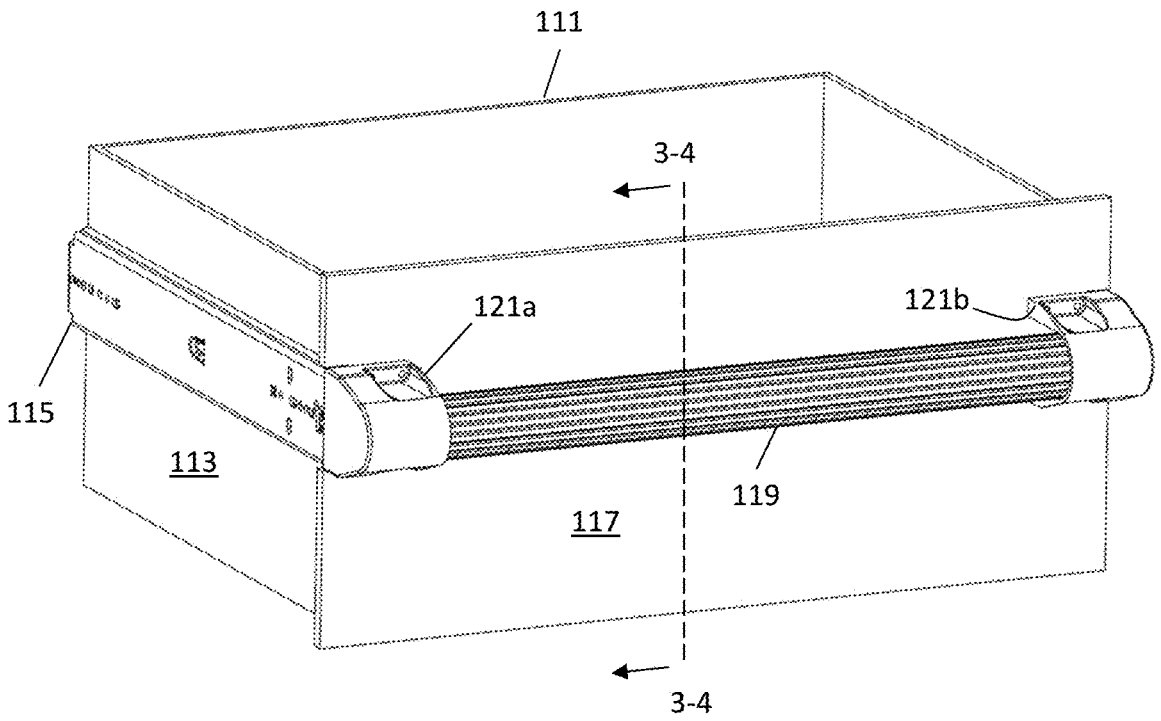
FIG. 1 is a perspective view of drawer with a drawer slide and a rotating bar for unlatching of the drawer slide, in accordance with aspects of the invention.

FIG. 1 is a perspective view of drawer with a drawer slide and a rotating bar for unlatching of the drawer slide. The drawer 111 is a drawer of a cabinet (not shown), with the cabinet generally including one or more drawers. The drawer of FIG. 1 is generally in the form of a rectangular box with an open top, allowing for access to contents of the drawer when the drawer is extended from the cabinet. In such a configuration, the drawer includes a drawer front panel 117, a drawer rear panel in parallel to the drawer front, with longitudinal vertical edges of the drawer rear panel connected to the drawer front panel by a left side panel 113 and a right side panel, in parallel. In some embodiments, and as shown in FIG. 1, the front panel extends slightly past the side panels.

Drawer slides are mounted to each of the side panels, from a rear to a forward end of the panels. A left side drawer slide 115 mounted to the left side panel is visible in FIG. 1. The drawer slides include a plurality of members, extendable from one another. The drawer slides are generally also mounted to a side of a frame of the cabinet or side walls of the cabinet, so that extension of the drawer slides allows the drawer to be extended from the cabinet, allowing access to the contents of the drawer.

A rotating bar 119 is coupled between end caps 121*a,b*. In the embodiment of FIG. 1, the rotating bar is cylindrical in outline, with ends of the cylinder extending into the end caps. The end caps are mounted to opposing edges of the front panel of the drawer, with the end caps mounted at a height corresponding to locations of the drawer slides. The drawer slides, or at least one of them, includes a latch for latching the drawer slides in an unextended position. Rotation of the rotating bar unlatches the latch, allowing for extension of the slides and opening of the drawer. The bar may be rotated, for example, by manipulating an upper surface of the bar towards the front panel of the drawer.

Figure 2:
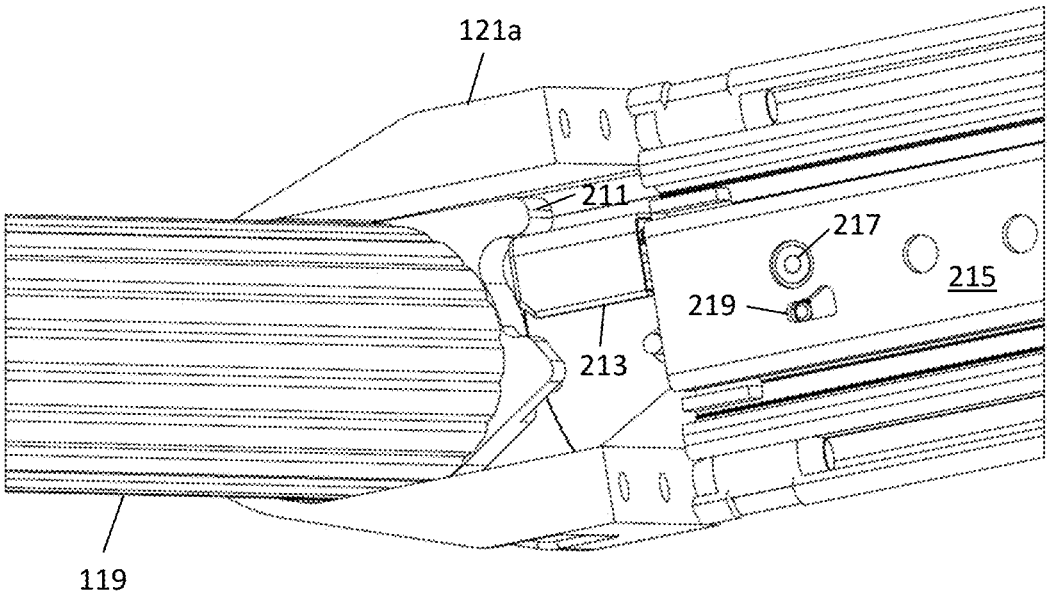
FIG. 2 is a perspective interior view of a portion of the rotating bar and drawer slide of FIG. 1, in accordance with aspects of the invention.

FIG. 2 is a perspective interior view of a portion of the rotating bar and drawer slide of FIG. 1, with the drawer omitted for clarity. An end of the rotating bar 119 is shown in a slot of the end cap 121*a*. The slot also includes an arm 211, coupled to the rotating bar. The arm may be part of an outer piece coupled or connected to the rotating bar. The arm is shown as just above a forward end of a release lever 213 of the drawer slide. The release lever extends forward from an inner member 215 of the drawer slide, with the release lever mounted to a web of the inner member by a rivet or pin 217. Rotation of the rotating bar causes rotation of the arm, with rotation of the arm pressing the front end of the release lever to pivot downward. In FIG. 2, the release lever is shown extending forward near a top edge of the inner member of the drawer slide. In various embodiments, however, the release lever may extend forward from other positions relative from the inner member. In addition, in various embodiments the drawer slide may be an unhanded drawer slide, namely able to be mounted to either a left side or a right side of a drawer. Accordingly, in various embodiments the rotating bar, arm, and release lever may be configured to press the front end of the release lever to pivot upward.

In some embodiments, pivoting of the release lever is constrained, by interaction of a pin 219 of the release lever and sides of a cutout in the inner member. Also, in some embodiments, the rotating bar is knurled, for example to improve grasping or rolling of the rotating bar. In the case of FIG. 2, the knurls are straight knurls extending lengthwise along the rotating bar.

Figure 3:
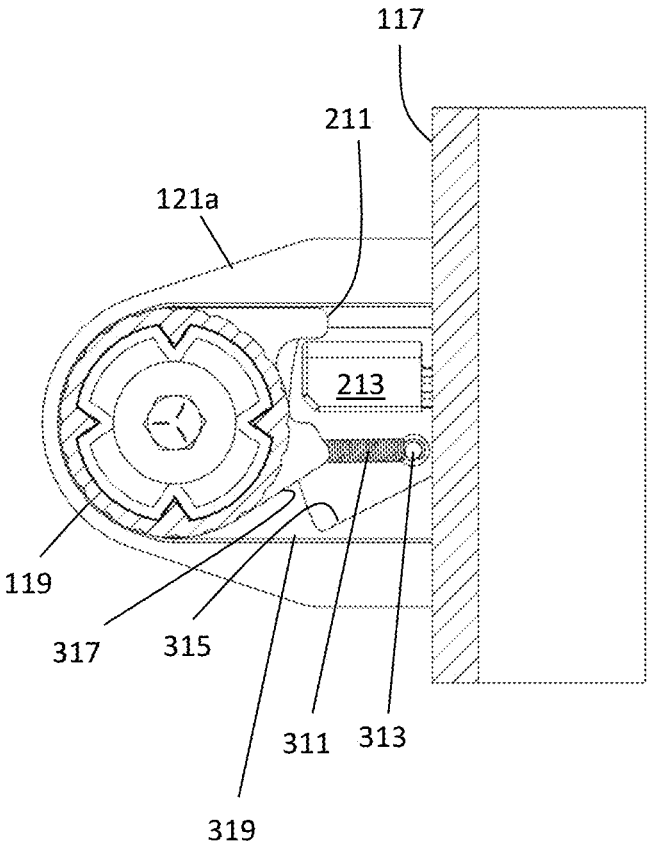
FIG. 3 is a side cross-sectional view of the drawer with the drawer slide and rotating bar of FIG. 1, with the rotating bar in an unrotated position.

FIG. 3 is a cross-sectional view of the slide and rotating bar coupled to the drawer of FIG. 1, along the sectional line 3-4 shown in FIG. 1. FIG. 3 shows the left end cap 121*a* mounted to the face of the front panel 117 of the drawer. The rotating bar 119 is mounted axially to the end cap, and an outline of the rotating bar is within an outline formed by the end cap. In FIG. 2, the rotating bar is shown in an unrotated position. With the rotating bar in the unrotated position, the arm 211, coupled to the rotating bar, is positioned above the release lever 213 of the drawer slide.

For FIG. 3, a spring 311 normally biases the rotating bar to the unrotated position. In the embodiment of FIG. 3, the spring is an extension spring, with one end mounted to the end cap and one end coupled to the rotating bar. In other embodiments other springs may be used.

Rotation of the rotating bar in the clockwise position (as viewed in FIG. 3, more generally rotation of the rotating bar such that the top of the bar moves closer to the face of the front panel) would result in the arm 211 pressing downward on the release lever and moving the forward end of the release lever downward (or, depending on the embodiment, pressing upward on the release lever and moving the forward end of the release lever upward). The release lever may be positioned in a cutout of an interior of the end cap. The cutout may provide additional room for movement of the release lever, for example allowing for increased dimensional tolerances for the release lever. In some embodiments a bottom surface 315 of the cutout provides a positive stop for downward movement of the forward end of the release lever. As illustrated in FIG. 3, however, engagement between a lower arm 317, coupled to the rotating bar, and an interior lower surface 319 of the end cap 121*a* provides the positive stop, by preventing over-rotation of the rotating bar.

Figure 4:
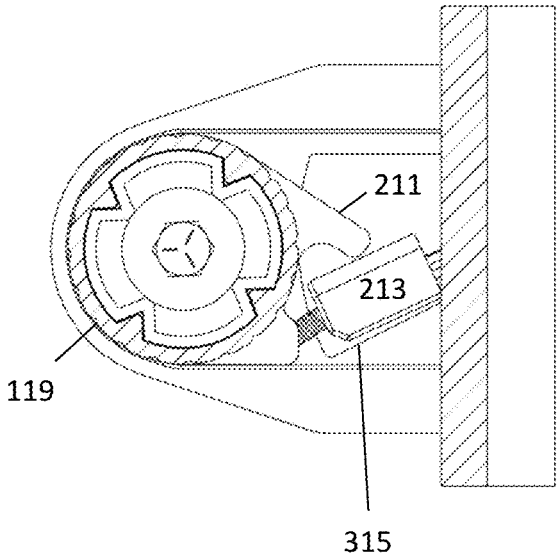
FIG. 4 is a side cross-sectional view of the drawer with the drawer slide and rotating bar of FIG. 1, with the rotating bar in a rotated position.

FIG. 4 is also a cross-sectional view of the slide and rotating bar coupled to the drawer of FIG. 1, along the sectional line 3-4 shown in FIG. 1. For FIG. 4, the rotating bar 119 is in the rotated position. With the rotating bar in the rotated position, the arm 211 has pressed down the forward end of the release lever 213. For FIG. 4, the forward end of the release lever has been depressed, and the lower arm has contacted the interior lower surface of the end cap, preventing further rotation of the rotating bar.

Figure 5:
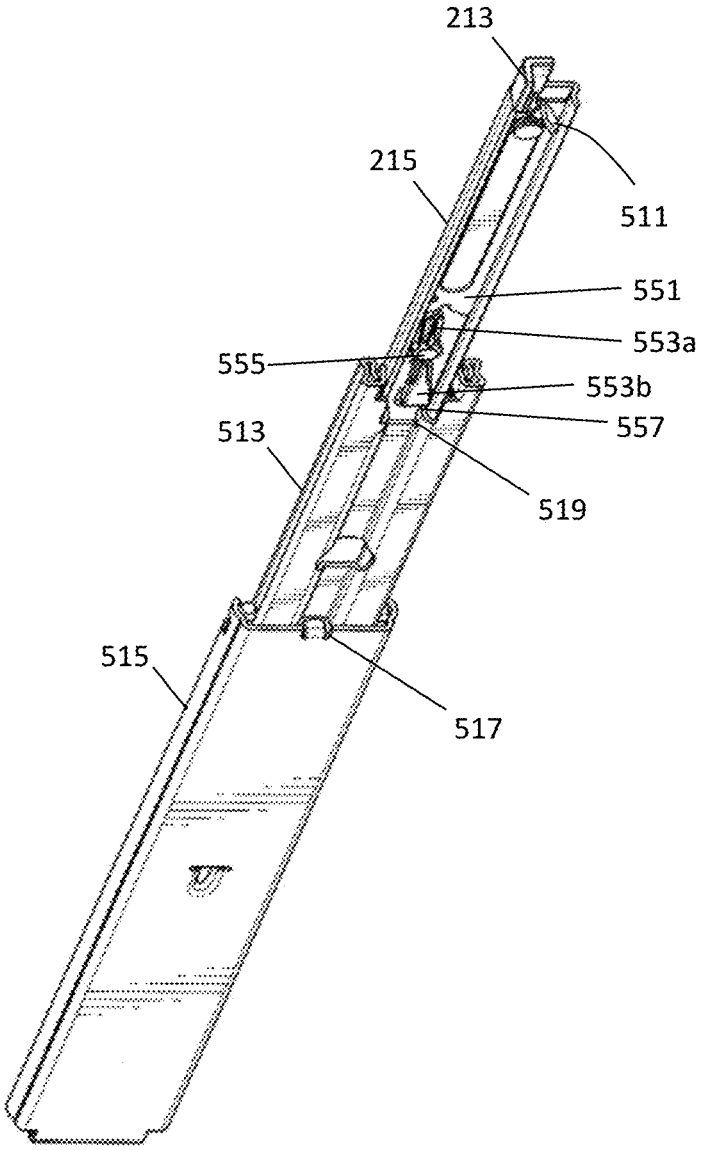
FIG. 5 is a perspective view of an embodiment of a drawer slide.

So that operation of the rotating bar of FIG. 1 may be more fully understood, FIG. 5 is a perspective view of a drawer slide that may be used with the invention. The drawer slide includes a latch arm on an extending member of the drawer slide, and a latch receiver on a fixed member of the drawer slide. For FIG. 5, the drawer slide is a three-member telescopic drawer slide. In various embodiments, the number of slide members may vary, and the drawer slide may be of a different type than a telescopic drawer slide.

The drawer slide of FIG. 5 includes an outer member 515, an intermediate member 513, and an inner slide member 215. Each member, whether the outer member, intermediate member, or inner member, generally comprises a longitudinal vertical web, with raceways extending horizontally from upper and lower margins of the vertical web. The raceways of the outer member and the intermediate member and the raceways of the intermediate member and inner member may be in contact with one another, as in a friction drawer slide. Perhaps more commonly, and as with the drawer slide of FIG. 5, sets of bearings slidably or rollably couple the raceways of the outer member and the intermediate member, and sets of bearings slidably or rollably couple the raceways of the intermediate member and inner member.

The outer member 515 is normally mounted to a cabinet frame or sidewall, with in some embodiments the web of the outer member being mounted the cabinet sidewall. The intermediate member 513 is nested within the outer member, with the intermediate member extendably coupled to the outer member. The inner member 215, in turn is nested within the intermediate member, with the inner member extendably coupled to the intermediate member. The inner member is normally mounted to a side of a drawer within the cabinet, with in some embodiments the web of the inner member being mounted on the side of the drawer.

A release lever 213 extends forward from the front of the inner member. The release lever is mounted to a pin or shoulder rivet, attached to the web of the inner member. A torsion spring, also attached to the pin or shoulder rivet, normally biases the release lever to an upward position, flush with and continuing a longitudinal line formed by the length of the upper raceway of the inner member. A tab 511 extends from a portion of a structure of the release lever. The tab extends in an inward direction from the web of the inner member, towards the outer member, with the slide in a retracted or closed position. The tab includes a ramped surface, so as to partially rotate the release lever and allow the tab to pass under a catch 517 of the outer member. The catch 517 may be a bent over portion at the end of the forward end of the outer member, positioned so as to capture the tab. Alternatively, the catch may in the form of a hook, shaped out of the web of the outer member, for example as shown in FIG. 1 (and other FIGs.) The intermediate member includes a cutout 519, positioned so as to allow the tab to interact with the catch of the outer member.

The slide of FIG. 5 also includes a feature to releasably latch the inner member in an extended position with respect to the intermediate member. In FIG. 5 an extending bar 551 extends along a web of the inner member, from just behind a structure providing the release lever and tab to a pivoting arm 553*a,b*. A forward end of the extending bar is in contact with a rearward edge of the structure providing the release lever and tab. A rearward end of the extending bar includes a concave surface, with the rearward end of the extending bar in contact with a forward end of the pivoting arm. The pivoting arm is pivotably mounted to the web of the inner member, for example by way of a shoulder rivet 555. The shoulder rivet passes through the pivoting arm at approximately a mid-point of the arm, with a narrow head 553*a* forward of the rivet, and a broader tail 553*b* rearward of the rivet. The broader tail includes more material than the narrow head, so the tail is normally biased downward by gravity. With the inner member extended from the intermediate member, a vertical rear edge of the tail contacts a stop-tab of the intermediate member. The contact between the vertical rear edge of the tail and the stop-tab prevents retraction of the inner member into the intermediate member. Depression of the release lever, however, forces the extending bar to translate rearward along the web of the inner member. This translation, in turn, forces a leading edge of the head of the pivoting arm to move along the rear concave surface of the extending bar, raising the tail above the stop-tab of the intermediated member and allowing for retraction of the inner member into the intermediate member. In addition, it may be noted that in some embodiments, and as illustrated in FIG. 5, the concavity at the rear of the extending bar and the pivoting arm are symmetrical about a horizontal axis, allowing for operation regardless of whether the drawer slide is mounted to a left side or right side of a drawer.

Figure 6:
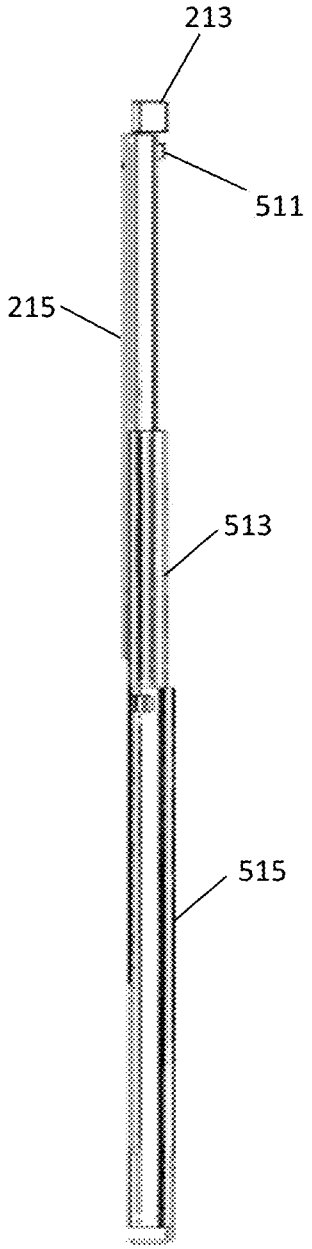
FIG. 6 is a top view of the drawer slide of FIG. 5.

FIG. 6 shows a top view of the slide of FIG. 5, in the extended position. The top view shows the outer member 515, the intermediate member 513 extending forward from the outer member, and the inner member 215 extending forward from the intermediate member. The top view also shows the release lever 213 extending forward from the inner member, and the tab 511 extending outward from the inner member in a direction towards a plane defined by the web of the outer member. FIG. 6 shows that the tab extends sufficiently far so as to engage with the catch of the outer member.

Figure 7:
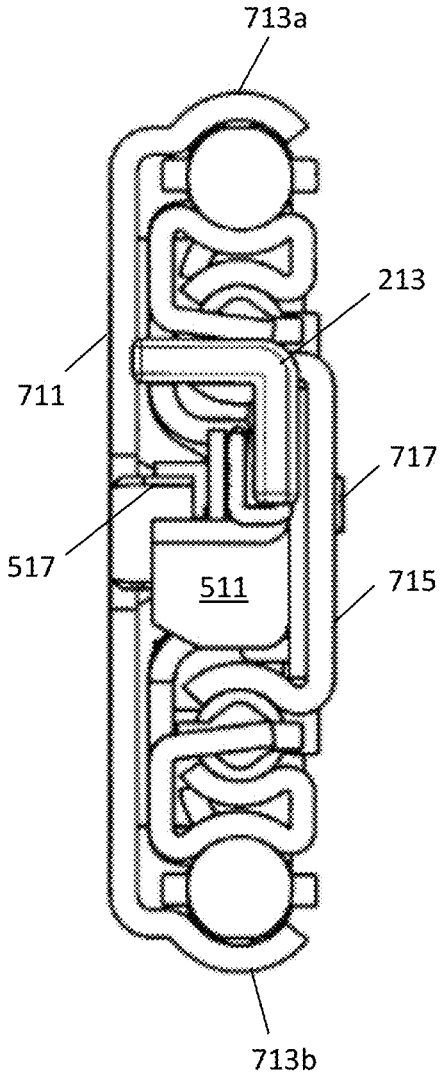
FIG. 7 is a front view of the drawer slide of FIG. 5.

FIG. 7 shows a front view of the slide of FIG. 5, also in the extended position. The front view of FIG. 7 shows the outer member including a vertical web 711 bounded by longitudinal opposing bearing raceways 713*a,b*. Sets of roller bearings are in the bearing raceways 713*a,b*, with the roller bearings also in corresponding vertically outward raceways of the intermediate member. The intermediate member may therefore be considered nested within the raceways of the outer member. Similar sets of roller bearings are in inward facing raceways of the intermediate member. The similar sets of roller bearings also in opposing outward facing bearing raceways of the inner member, with the outward facing bearing raceways of the inner member longitudinally bounding a vertical web 715 of the inner member. The inner member may therefore be considered nested within raceways of the intermediate member.

The release lever is mounted to an interior of the web of the inner member. In FIG. 7 the release lever is mounted to the web by a rivet 717 that extends through the web of the inner member. The front view illustrates the ramped tab 511 as positioned below the release lever 213. The ramped tab extends sufficiently far so as to allow for capture of the tab by the catch 517 of the outer member. The catch of the outer member is a bent over piece of the web of the outer member, with the bent over piece extending towards the web of the inner member. Capture of the ramped tab by the catch latches the drawer slide in an unextended position. Depression of the release lever allows the ramped tab to clear the catch, unlatching the drawer slide and allowing the drawer slide to be extended.

Figure 8:
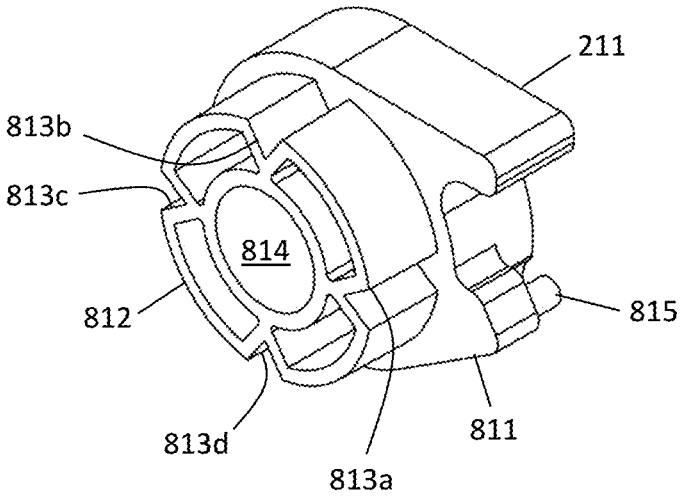
FIG. 8 is a perspective view of an outer piece, including an extending arm, which connects to an end of the rotating bar, in accordance with aspects of the invention.

Returning to discussion more specifically relating to operation of a rotating bar, FIG. 8 is a perspective view of an outer piece, including an extending arm, which connects to an end of the rotating bar. The outer piece includes a planar piece 811. The arm 211, used to press the release lever, is formed as part of the planar piece 811.

A roughly cylindrical portion 812 extends out from one side of the planar piece. The roughly cylindrical portion is sized to fit within an inner profile of a rotating bar. In the embodiment of FIG. 8, an outer perimeter of the roughly cylindrical portion includes a plurality of slots 813*a-d*, equidistantly spaced V-shaped slots as illustrated in FIG. 8. The slots are positioned and sized so as to receive corresponding registration protuberances on an inner surface of the rotating bar. The roughly cylindrical portion may therefore more securely maintain relative position of the outer piece and the rotating bar.

The roughly cylindrical portion also includes a central axial aperture 814, which also extends through the planar piece. The axial aperture may be used to mount the outer piece to and within an end cap, for example using a washer and a screw or a bolt engaged by the end cap, allowing for rotation of the outer piece about the axial aperture.

FIG. 8 also shows a pin 815 formed of the planar piece, somewhat below the arm 211. The pin may be used for attachment of a spring. The spring may normally bias the outer piece (and the rotating bar) to an unrotated position, for example as discussed with respect to earlier figures.

Figure 9:
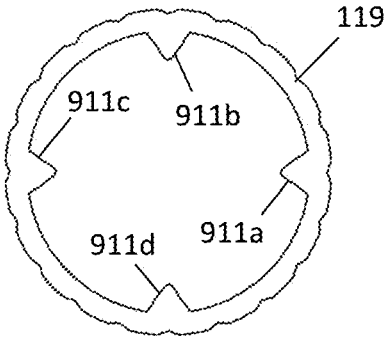
FIG. 9 illustrates a profile a rotating bar, in accordance with aspects of the invention.

FIG. 9 illustrates a profile a rotating bar 119. The profile of the rotating bar shows that the rotating bar has a roughly annular cross-section. The rotating bar has a roughly circular knurled outer surface for the annular cross-section, and a roughly inner surface, roughly radially parallel to the outer surface. The inner surface includes a plurality of registration protuberances 911*a-d*. For FIG. 9, the registration protuberances are equidistantly spaced and have a generally triangular cross-section, so as to mate with the V-shaped slots of the outer piece of FIG. 8.

Figure 10:
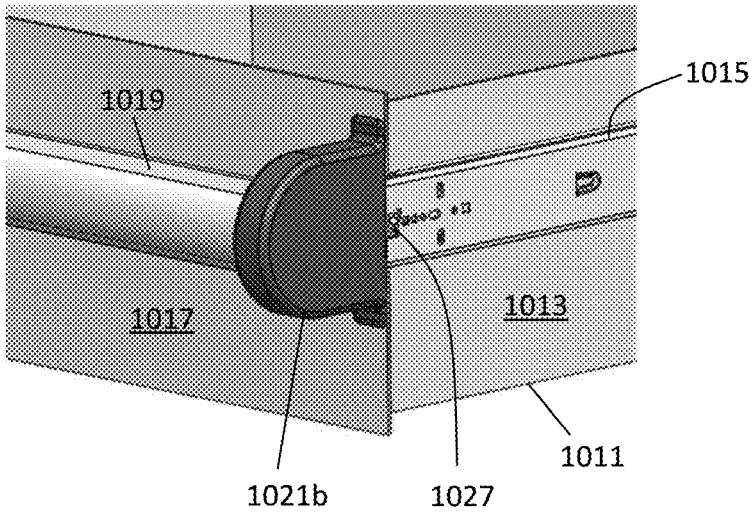
FIG. 10 is a partial perspective view of drawer with a drawer slide and a further rotating bar for unlatching of the drawer slide, in accordance with aspects of the invention.

FIG. 10 is a perspective partial view showing a slide 1015 and a rotating bar 1019 coupled to a drawer 1011. The slide is mounted to a side 1013 of the drawer 1011, generally lengthwise between a rear and a front of the drawer. In most embodiments a second slide (not shown in FIG. 10) is mounted to the opposing side of the drawer. Position of the second slide may mirror the position of the slide on the side of the drawer. The slide allows for extension of the drawer from a piece of furniture. By example and not limitation, the furniture may be a cabinet or a rack. By example and not limitation, the drawer may be constructed out of wood, metal or plastic. The slide includes a latch (not shown in FIG. 10) for keeping the slide in a retracted position, hence keeping the drawer in a closed position.

The rotating bar 1019 is coupled to the front 1017 of the drawer 1011 by a left end cap (not shown in FIG. 10) and a right end cap 1021*b*, each end cap mounted on opposing sides of the front of the drawer. The rotating bar may have a length between the left end cap and the right end cap that is equal to a distance between the left end cap and the right end cap. In many embodiments, the rotating bar has a length sufficient to extend into the left and right end caps. The rotating bar may be dimensioned to have a height along a vertical plane that is within a dimension of vertical height of the left end cap and the right end cap. The rotating bar may be cylindrical. In other examples, the rotating bar 1019 may have combination of at least one arcuate surface and straight surfaces.

The left end cap and the right end cap 1021*b* may be positioned on the front 1017 of the drawer 1011 such that the slide 1015 and the left end cap and the right end cap 1021*b* are in horizontal alignment. The left end cap and the right end cap may be flush with the left and right edges of the front of the drawer, respectively. In other examples, the left end cap and the right end cap may be spaced away from the left and right edges of the front of the drawer, respectively. Although, in many embodiments, the spacing of such configurations has at least a portion of the left and right end caps in alignment with the slide. Such an alignment may facilitate latching and unlatching.

Activation of the rotating bar 1019 unlatches the latch, allowing for extension of the slide 1015, hence opening of the drawer 1011. The rotating bar may be activated by rotating the rotating bar to unlatch the slide. The rotating bar is in engagement with a release lever (see 1033 in FIG. 11) The release lever is coupled to a tab. (See 1025 in FIG. 12, or in some embodiments, 511 in FIG. 5) In some embodiments, the release lever and tab are integrally formed in one structure. The tab extends in an inward direction from the web of an inner member of the slide, towards an outer member, with the slide in a retracted or closed position. The tab includes a ramped surface. Contact between the ramped surface and a catch 1027 of the outer member, on closing of the slide, partially rotates the release lever and allows the tab to pass under the catch. The catch may be a bent over portion at the end of the forward end of the outer member. The catch may be positioned so as to capture the tab. Alternatively, the catch may be in the form of a hook, shaped out of the web of the outer member, for example as shown in FIG. 13 (and other FIGs.) Rotation of the rotating bar 1019 may effectively push the release lever and the tab down (or up, depending on the embodiment), resulting in the tab exiting the catch (see FIG. 13).

Figure 11:
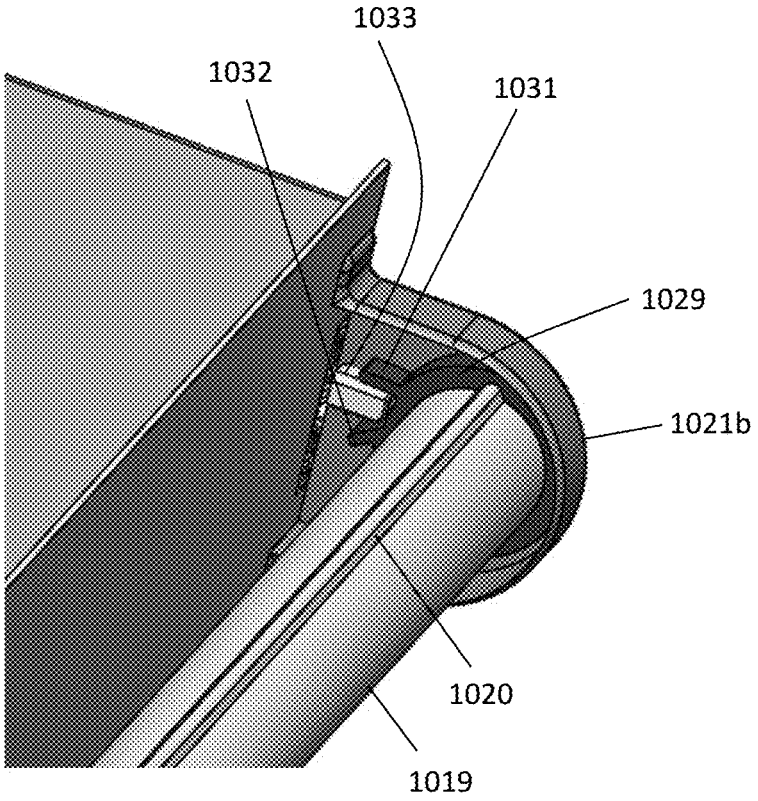
FIG. 11 is a further partial perspective view of the drawer with the drawer slide and further rotating bar of FIG. 10.

FIG. 11 is a perspective partial view of the further rotating bar 1019 coupled to the drawer of FIG. 10. FIG. 11 shows a portion of an extending arm 1031, with the extending arm extending over the release lever 1033 of the slide. The extending arm is pivoted through rotation of the rotating bar, for example about a central axis of the rotating bar or parallel to the axis of the rotating bar. The extending arm may protrude from a ring 1029 sleeved over, or coupled to an end of the rotating bar, for example as shown in FIG. 11. In other examples, the extending arm may extend from the rotating bar. The extending arm 1031 may be within the right end cap. The extending arm may cover less than an entirety of a top surface of the release lever 1033. A second arm 1032 may extend under the release lever. In some examples, the second arm may be dimensioned such that the second arm contacts the end cap, for example a bottom interior surface of the end cap, when the rotating bar is rotated. This may restrict the travel of the release lever during rotation, for example by performing a stop function for the rotation. The second arm may cast a wider angle in the direction of the rotation with respect to the ring of the extending arm than the extending arm. The second arm may prevent the extending arm from overexerting a downward force on the release lever when the release lever is in a position to unlatch the slide.

The rotating bar 1019 may be rotated, for example, by gripping and twisting the rotating bar about its axis. In other examples, such as in FIG. 11, there may be a grip 1020 extending out of the rotating bar. The grip may provide for increased ease of gripping or rotating of the rotating bar. The grip may run the length of the rotating bar between the left end cap and the right end cap 1021*b*, for example along a top of the rotating bar with the rotating bar in the unrotated position. The bar may be rotated, for example, by manipulating the top grip so as to move the top grip forward, towards the drawer. There may be a plurality of grips spaced away from each other on the rotating bar. The plurality of grips may allow for different pressing points to unlock the drawer. Yet in other examples, there may be a groove on the rotating bar. The groove, for example, may also allow for increased ease of gripping or rotating the rotating bar.

Figure 12:
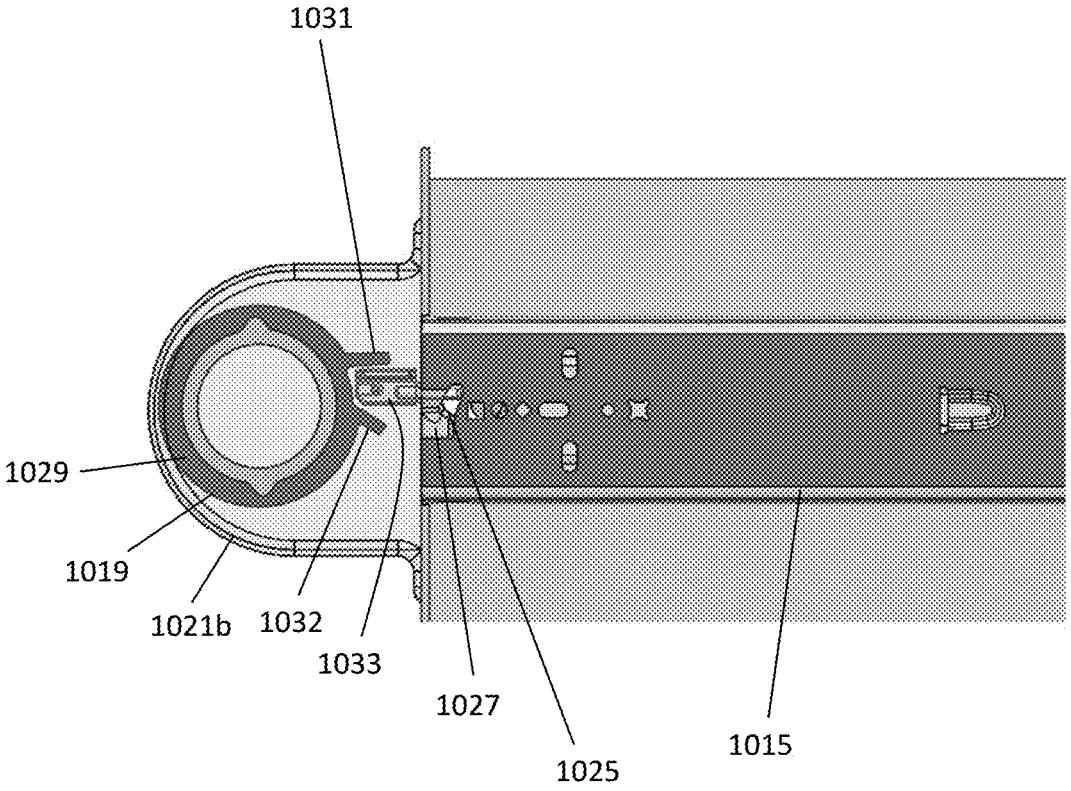
FIG. 12 is a side view of the drawer with the drawer slide and further rotating bar of FIG. 10, with the further rotating bar in an unrotated position, and with an end cap side wall ghosted.
Figure 13:
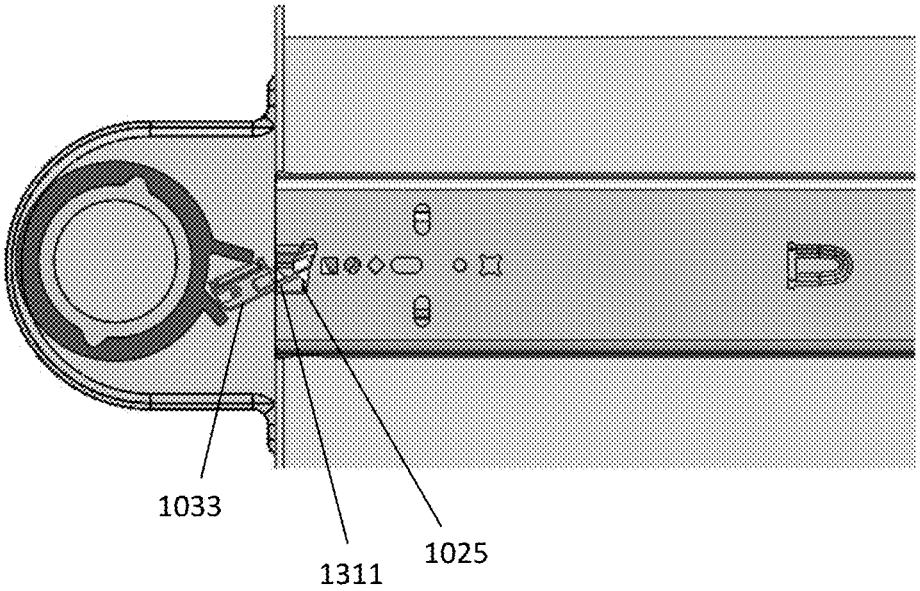
FIG. 13 is a side view of the drawer with the drawer slide and further rotating bar of FIG. 10, with the further rotating bar in a rotated position, and with an end cap side wall ghosted.

FIG. 12 is a side view of the drawer 1011 with the drawer slide 1015 and the further rotating bar 1019 of FIG. 10, with the further rotating bar in an unrotated position, and with the end cap 1021*b* sidewall made transparent. In the unrotated position, the extending arm 1031 may be approximately parallel to a horizontal plane. The extending arm 1031 may partially extend over the release lever 1033. The extending arm 1031 may be vertically spaced away from the release lever, for example as shown in FIG. 12. In other examples, the extending arm may be flush against the release lever. The release lever may be approximately parallel to the horizontal plane. The second arm may be vertically spaced away from the release lever, also as shown in FIG. 12 by example.

A structure involving the release lever 1033 also includes the tab 1025, extending out of the page in FIG. 12, with the tab 1025 captured by the catch 1027 shaped out of the web of the outer member of the slide 1015 of the drawer 1011. The catch may be considered to provide an opening extending into a front edge of the outer member, with the opening further extending vertically upwards away from the front edge of the outer member. Hence, the catch may be considered to create a retaining hook in the outer member of the slide, with the tab 1025 to be captured by the catch.

FIG. 13 is a side view of the drawer 1011 with the slide 1015 and further rotating bar 1019 of FIG. 10, with the further rotating bar in a rotated position, and with the end cap 1021*b* sidewall made transparent. The rotating bar has been actuated, or rotated to the rotated position, resulting in the tab 1025 of the release lever 1033 clearing the catch 1027 of the outer member of the slide. When actuated, the rotating bar may be rotated about its central axis in a direction towards the front 1017 of the drawer. The extending arm 1031 may rotate in the same direction with the rotating bar 1019. Rotation of the extending arm may press on a forward end of the release lever 1033, resulting in the tab 1025 clearing the catch 1027. The rotation may come to a stop when the second arm 1032 makes contact with the end cap. In some examples, a spring may normally bias the rotating bar 1019 towards an unrotated position. As the release lever is mounted to the inner member of the slide, the inner member of the slide is free to extend from the outer member of the slide thereafter. Hence, the drawer 1011 is unlatched.

Figure 14:
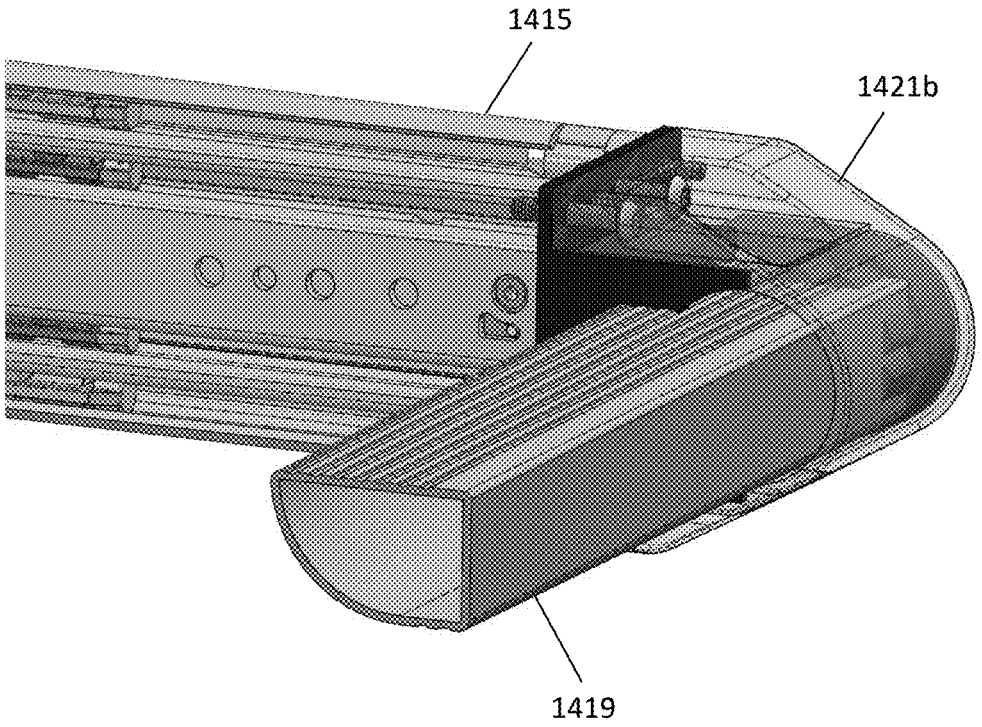
FIG. 14 is a partial side view of a still further rotating bar and drawer slide, with the rotating bar in an unrotated position, in accordance with aspects of the invention.

FIG. 14 is a partial side view of a still further rotating bar and drawer slide, with the rotating bar in an unrotated position. For clarity, the drawer to which the drawer slide is normally mounted has been largely omitted. In FIG. 14, a portion of a further rotating bar 1419 is shown having one end in a right side end cap 1421*b*. The end cap is positioned forward of a drawer slide 1415. The drawer slide may be as previously discussed with respect to the embodiment of FIG. 1 or FIGS. 5-7.

The rotating bar of FIG. 14 is shown as having a knurled flat upper surface, and a flat forward surface extending downward from a forward edge of the upper surface. A rear edge of the upper surface and a bottom edge of the forward surface are connected by a curved section. In the embodiment of FIG. 14, the upper surface has a width (from the forward edge to the rear edge) slightly longer than a height of the forward surface (from the forward edge to the bottom edge). The cross-sectional shape of the rotating bar of FIG. 14 may therefore be considered to be that of a quarter of an ellipse with a slight eccentricity, with a major axis running along a line on the upper surface defining its width (from the forward edge to the rear edge) and a minor axis running along a line on the forward surface defining its height (from the forward edge to the bottom edge).

Figure 15:
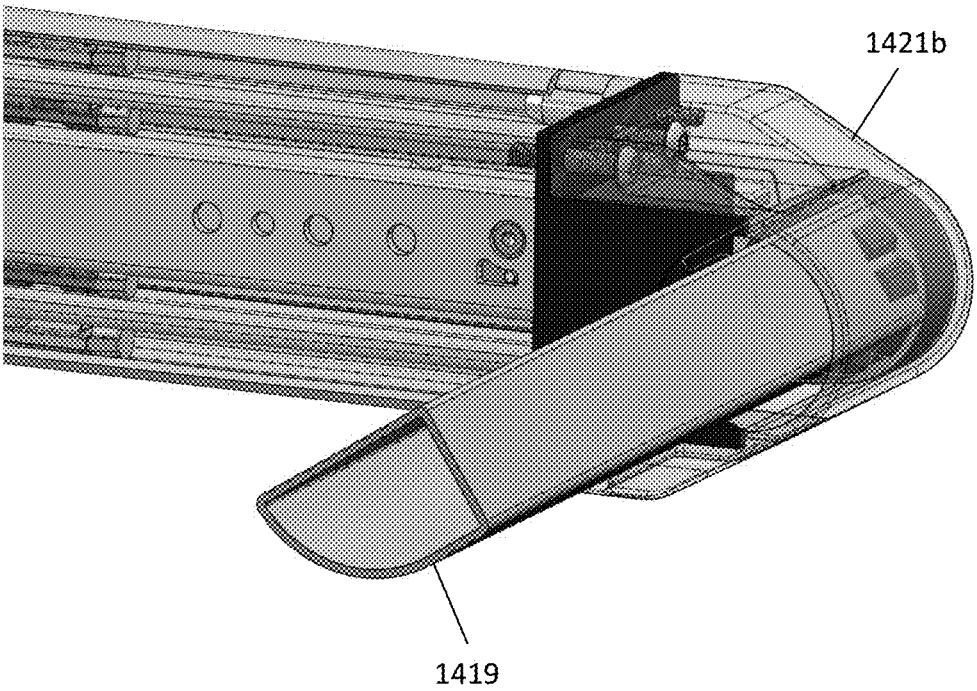
FIG. 15 is a further partial side view of the still further rotating bar and drawer slide of FIG. 14, with the rotating bar in a rotated position.

The rotating bar of FIG. 14 is also shown as being in the unrotated position. In the unrotated position, the upper surface is shown as generally parallel to a direction of extension of the drawer slide. FIG. 15 is a further partial side view of the still further rotating bar and drawer slide of FIG. 14, with the rotating bar in a rotated position. The rotating bar may be rotated from the unrotated position to the rotated position by, for example, pressing down on a rearward portion of the rotating bar, which also move the rearward portion of the rotating bar somewhat towards the drawer. In the rotated position, the rotating bar has its rear edge depressed downward, with the upper surface tilted approximately 45 degrees from the direction of extension of the drawer slide. In the rotated position, the rotating bar, or more particularly an arm fixedly coupled to the rotating bar, depresses a release lever of the drawer slide, which unlatches the drawer slide.

Figure 16:
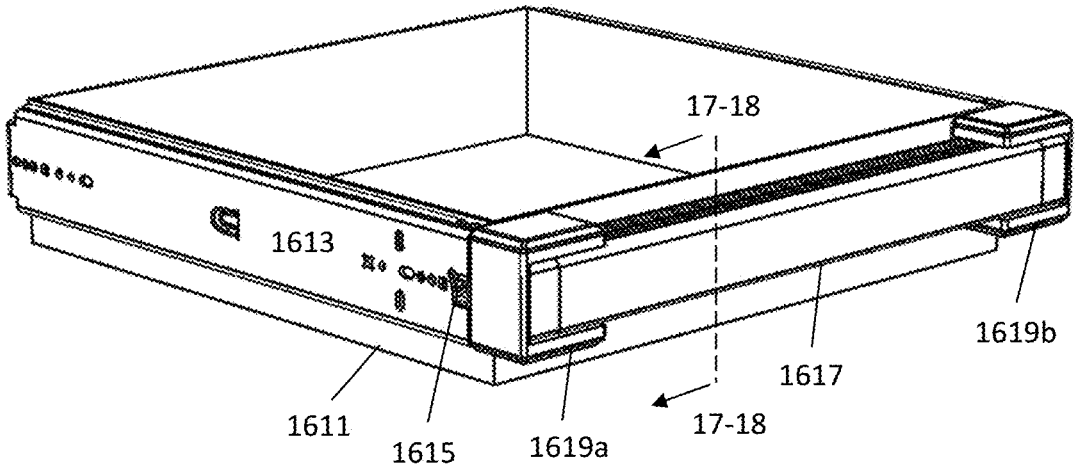
FIG. 16 is a perspective view of drawer with a drawer slide and a rotating bar for unlatching of the drawer slide, in accordance with aspects of the invention.

FIG. 16 is a perspective view of drawer with a drawer slide and a rotating bar for unlatching of the drawer slide. As in FIG. 1, the drawer 1611 is a drawer of a cabinet (not shown), with the cabinet generally including one or more drawers. Drawer slides are mounted to each of the side panels of the drawer, from a rear to a forward end of the panels. A left side drawer slide is visible in FIG. 16, mounted to the left side panel of the drawer.

A rotating bar 1617 is coupled between end caps 1619*a,b*. In the embodiment of FIG. 16, the rotating bar includes a generally flat horizontal planar upper surface and a generally flat vertical planar front surface. The front surface generally extends downward from a forward edge of the flat upper surface, with the edge between the upper surface and the front surface being rounded. The end caps are mounted to opposing side edges of the front panel of the drawer, with the end caps mounted at a height corresponding to locations of the drawer slides. The end caps of the embodiment of FIG. 16 form generally U-shaped channels, open to the front and rear. The U-shaped channels face each other, with opposing ends of the rotating bar in the U-shaped channels of the opposing end caps.

The drawer slides, or at least one of them, includes a latch for latching the drawer slides in an unextended position. In the embodiment of FIG. 16, the outer member includes a hook 1615 formed by a cutout in a forward edge of the web of the outer member, with the hook configured to capture a tab extending from the inner member. Rotation of the rotating bar unlatches the latch, allowing for extension of the slides and opening of the drawer.

Figure 17:
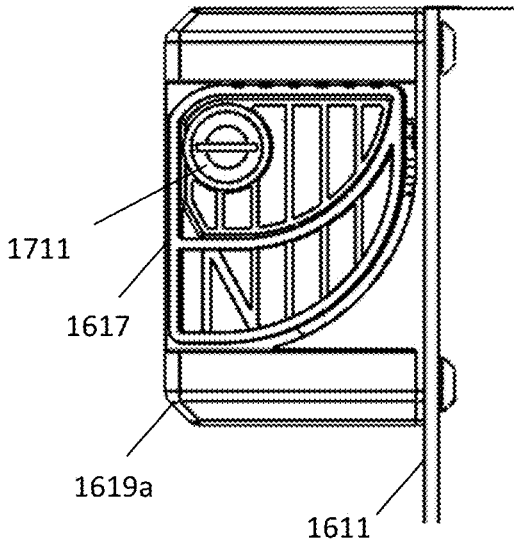
FIG. 17 is a side cross-sectional view of the drawer with the drawer slide and rotating bar of FIG. 16, with the rotating bar in an unrotated position.

FIG. 17 is a side cross-sectional view of the drawer with the drawer slide and rotating bar of FIG. 16, with the rotating bar in an unrotated position. In FIG. 17, a top and a bottom of the end cap 1619*a* brackets the rotating bar 1617. The end cap is mounted to a front of the drawer 1611. The flat upper surface of the rotating bar has a width slightly less than a width of the end cap. The upper surface may be knurled as shown in FIG. 17. The front surface of the rotating bar is generally in the same plane as a forward surface of the end cap. A rear surface of the rotating bar couples a lower edge of the front surface with a rear edge of the upper surface, as will be discussed with respect to FIG. 19. In short, in cross-section the rear surface forms a curved section. In the embodiment of FIG. 17, the upper surface has a width (from the forward edge to the rear edge) slightly shorter than a height of the forward surface (from the forward edge to the bottom edge). The cross-sectional shape of the rotating bar of FIG. 17 may therefore be considered to be that of generally a quarter of an ellipse with a slight eccentricity, with a major axis running along a line on the front surface defining its height (from the bottom edge to the front edge) and a minor axis running along a line on the upper surface defining its width (from the forward edge to the rear edge). In this regard, the major and minor axis of the ellipse for the bar of FIG. 17 are reversed compared to the major and minor axis of the ellipse for the bar of FIG. 14.

Figure 20:
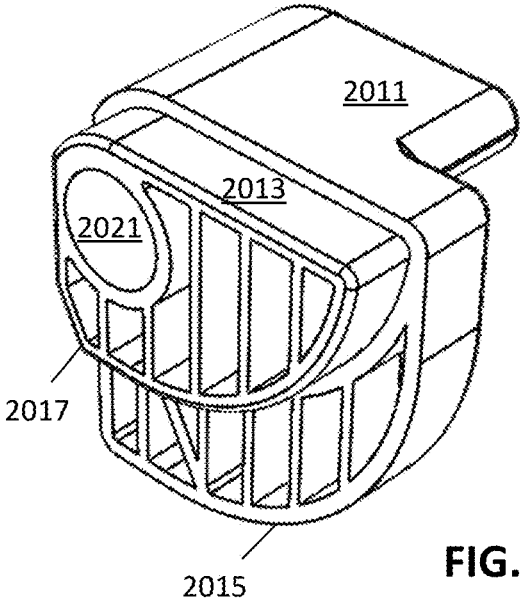
FIG. 20 is a perspective rear inside side view of an outer piece to be connected to the rotating bar.
Figure 21:
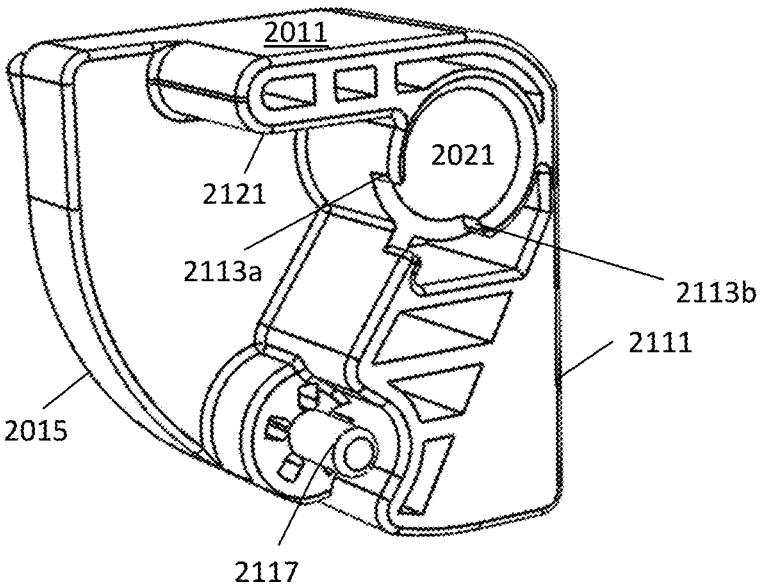
FIG. 21 is a perspective rear outside side view of the outer piece of FIG. 20.

The rotating bar is coupled to an outer piece, with the outer piece more fully discussed with respect to FIGS. 20 and 21. The outer piece may be seen in FIG. 17 as inset to outer surfaces of the rotating bar. A bolt 1711 is used to rotatably couple the outer piece (and hence the rotating bar) to the end cap. The bolt passes through an aperture of the outer piece, at a location just inset from the rounded edge coupling the front of the upper surface and front surface of the rotating bar.

Figure 18:
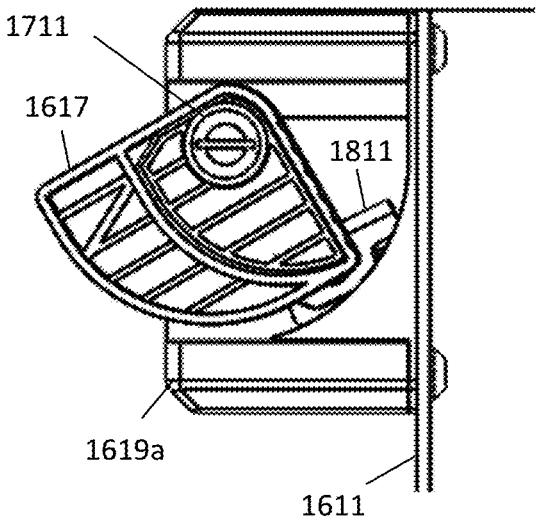
FIG. 18 is a side cross-sectional view of the drawer with the drawer slide and rotating bar of FIG. 16, with the rotating bar in a rotated position.

FIG. 18 is a side cross-sectional view of the drawer with the drawer slide and rotating bar of FIG. 16, with the rotating bar 1617 in a rotated position. The rotating bar may be rotated from the unrotated position to the rotated position by, for example, pressing down on a rearward portion of the rotating bar. Compared to the non-rotated position of FIG. 17, the rotating bar has been rotated clockwise (viewed down the bar towards the left end cap 1619*a*) about an axis of the bolt 1711. In the rotated position, the lower edge of the front surface protrudes from a plane defined by a front of the end cap, and the rear edge of the upper surface is moved closer to a plane defined by a bottom of the end cap.

With the rotating bar in the rotated position, a release lever 1811 is also depressed. The release lever is for releasing the inner member of the drawer slide, for example as previously discussed with respect to other figures.

Figure 19:
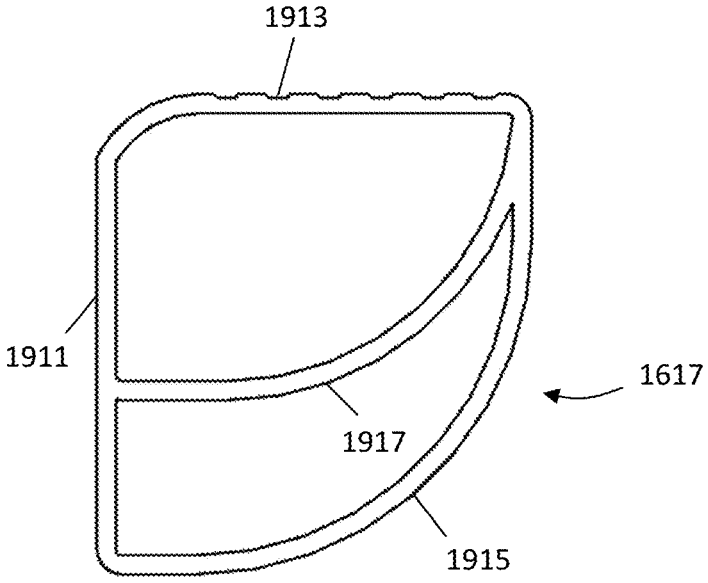
FIG. 19 illustrates an example profile of the rotating bar of FIG. 16.

FIG. 19 illustrates an example profile of the rotating bar 1617 of FIG. 16. The rotating bar includes an upper surface 1913. The upper surface is substantially flat, with a knurled top. A forward edge of the upper surface is rounded, and blends into a front surface 1911. The front surface is generally at 90 degrees to the upper surface. A curved section 1915 couples a rear edge of the upper surface and a lower edge of the front surface. The curved section is generally convex in FIG. 19. The upper surface has a width (front edge to rear edge) slightly less than a height of the front surface (bottom edge to top edge, the front edge of the upper surface). The overall profile of the rotating bar is therefore substantially a quarter of an ellipse, having a major axis along the front surface and a minor axis along the upper surface.

The profile of the rotating bar also has a further curved section 1917. The further curved section extends from an interior of the front surface, approximately ⅓ of the distance from the bottom edge to the top edge in FIG. 19, to the rear edge of the upper surface. In doing so, the further curved section merges with the curved section proximate the rear edge of the upper surface. The presence of the further curved section may provide for increased engagement with an outer piece coupled to the rotating bar.

FIG. 20 is a perspective rear inside side view of an outer piece to be connected to the rotating bar. In this regard, the "inside" of the outer piece for convenience may be considered the side of the outer piece that mates with the rotating bar. As such, the outer piece includes a fitting bounded by an upper surface 2013, a curved section 2017, and a front surface not visible in FIG. 20. The fitting is dimensioned to correspond to and snugly fit within the portion of the rotating bar profile bounded by the upper surface 1913, front surface 1911 and further curved section 1917 discussed with respect to FIG. 19. The fitting extends inward (towards the rotating bar when considering FIG. 20) from a base. The base, on the inward side, includes an upper surface 2011, a curve section 2015, and a front surface not visible in FIG. 20, all of which have dimensions corresponding to dimensions of the upper surface 1913, front surface 1911, and further curved section 1917 of the rotating bar. A profile of the base of the outer piece therefore matches the profile of the rotating bar, with the fitting extending into an interior of the rotating bar. In addition, the outer piece includes an aperture 2021 extending through the fitting and the base proximate the rounded front edge coupling the upper surface and the front surface. The aperture may receive a bolt, for example, to rotatably mount the outer piece to an end cap, as discussed for example with respect to FIGS. 17-18.

FIG. 21 is a perspective rear outside side view of the outer piece of FIG. 20. In this regard, the "outside" of the outer piece for convenience may be considered the side of the outer piece away from the rotating bar, when the outer piece is mated with the rotating bar. FIG. 21 indicates the upper surface 2011 and the curved section 2015, as discussed with respect to FIG. 20. FIG. 21 also indicates an outside edge of the front surface 2111, with the front surface connecting the upper surface and the curved section. The aperture 2021 may also be seen proximate the rounded front edge coupling the upper surface and the front surface. A circumferential edge of the aperture includes a slot bounded by opposing stop surfaces 2113*a,b*. The slot is positioned about the aperture so as to receive a tab (2223 in FIG. 22), with rotation of the outer piece constrained in opposing directions by contact between the stop surfaces 2113*a,b* and the tab.

Part of the upper surface also forms an arm 2121. In FIG. 21 the arm does not extend the entire length of the upper surface, with instead the arm ending before reaching the curved section. The arm may be used to engage with a release lever of a drawer slide. A pin 2117 is also formed in the outside of the outer piece. In FIG. 21, the pin is proximate the curved section, as the curved section approaches the front surface. The pin may be used for connecting a spring to the outer piece, for example to normally bias the outer piece, and hence the rotating bar, to an unrotated position.

Figure 22:
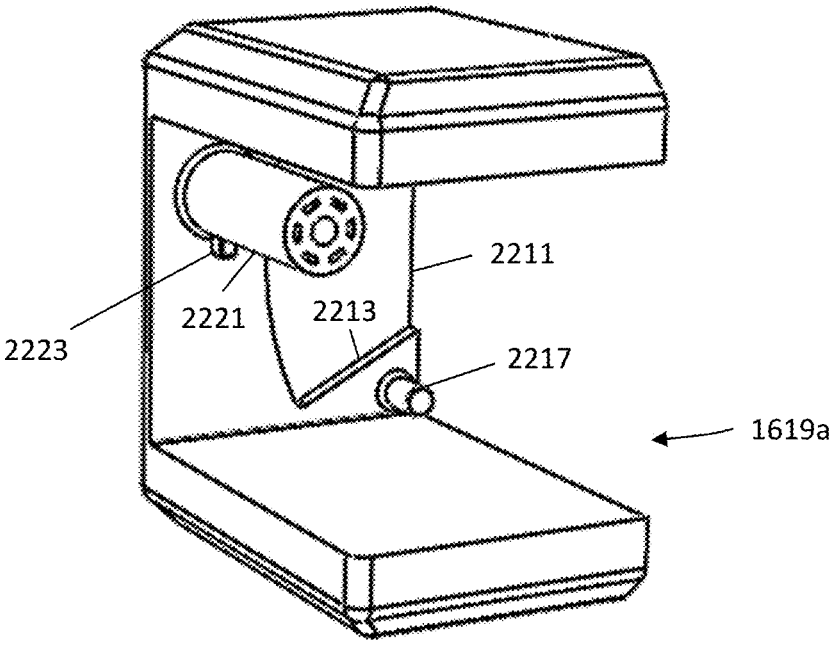
FIG. 22 is a perspective rear inside view of an end cap of FIG. 16.

FIG. 22 is a perspective rear inside view of an end cap of FIG. 16. As may be recalled, the end cap 1619*a* forms a substantially U-shaped channel, with the U-shaped channel being oriented horizontally rather than vertically. A cylindrical support, dimensioned to fit within the aperture 2021 of the outer piece, extends from the bottom of the U-shaped channel. As the bottom of the U-shaped channel forms a side of the end cap, the cylindrical support extends towards the rotating bar, when coupled to the end cap. As the cylindrical support fits within the aperture 2021 of the outer piece, the outer piece may be rotated about the cylindrical support. The tab 2223 slightly extends from the bottom of the U-shaped channel along an edge of the cylinder. The tab is positioned and dimensioned to fit in the slot about the edge of the aperture of the outer piece. As discussed with respect to FIG. 21, the tab and ends of the slot serve to provide rotational stops for the outer piece.

A cutout 2211 is formed in the bottom of the U-shaped channel forming the side of the end cap. The cutout may partially receive the release lever of the drawer slide. The cutout is bounded by a lower surface 2213. In some embodiments the lower surface may provide a positive stop to downward motion of the release lever. In most embodiments, however, the cutout simply serves to provide additional room for movement of the release lever, for example allowing for increased dimensional tolerances for the release lever.

In addition, the end cap includes a pin 2217. As illustrated in FIG. 22, the pin extends from the bottom of the U-shaped channel, just below the stop surface 2213. The pin may be used for connecting a spring to the end cap, for normally biasing the outer piece and rotating bar to the unrotated position. For example, in some embodiments a spring may be connected between the pin 2217 of the end cap and the pin 2117 of the outer piece.

Figure 23:
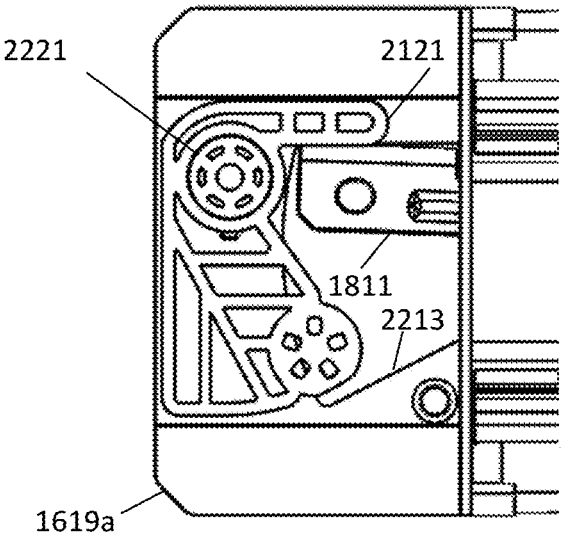
FIG. 23 is a section view inside the end cap, with the rotating bar in the unrotated position.

FIG. 23 is a section view inside the end cap, with the rotating bar in the unrotated position. FIG. 23 shows the arm 2121 of the outer piece over a forward end of a release lever 1811 of a drawer slide. The arm and a forward portion of the release lever are within a volume defined by the end cap 1619*a*. The release lever may be coupled to an inner member of a drawer slide, as previously discussed. The outer piece and the arm, which is part of the outer piece, are rotatable about the cylindrical support 2211 of the end cap, with the cylindrical support extending into the aperture of the outer piece.

Figure 24:
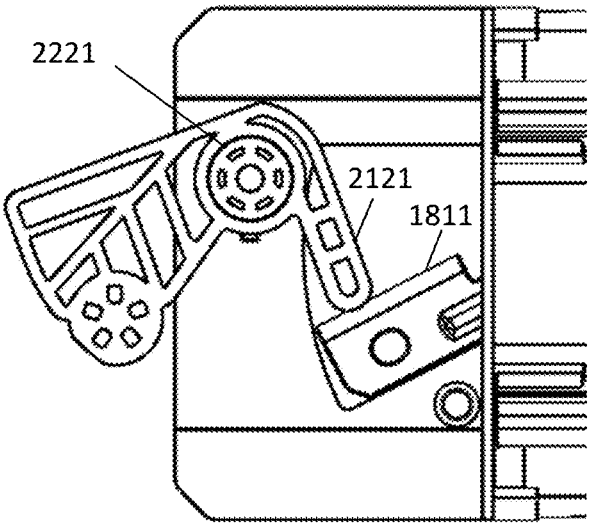
FIG. 24 is a further section view inside the end cap, with the rotating bar in the rotated position.

FIG. 24 is a further section view inside the end cap, with the rotating bar in the rotated position. In the rotated position, the arm 2121 of the outer piece has depressed the release lever 1811, thereby unlatching the latch of the drawer slide to which the release lever is attached. The release lever is depressed to a position at which the release lever contacts the stop surface 2213 (labeled in FIG. 23 for clarity) of the cutout in the end cap.

Figure 25:
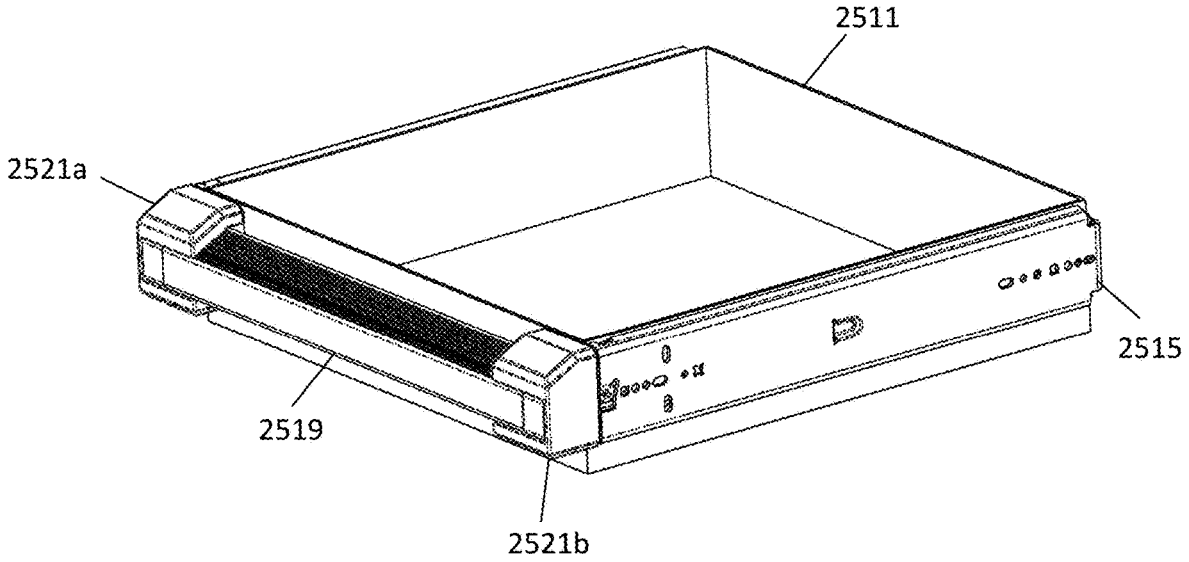
FIG. 25 is a perspective view of drawer with a drawer slide and a rotating bar for unlatching of the drawer slide, in accordance with aspects of the invention.

FIG. 25 is a perspective view of drawer with a drawer slide and a rotating bar for unlatching of the drawer slide. As in FIG. 1, the drawer 2511 is a drawer of a cabinet (not shown), with the cabinet generally including one or more drawers. Drawer slides are mounted to each of the side panels of the drawer, from a rear to a forward end of the panels. A right side drawer slide 2515 is visible in FIG. 25, mounted to the right side panel of the drawer.

A rotating bar 2519 is coupled between end caps 2521*a,b*. In the embodiment of FIG. 25, the rotating bar includes a downward angled upper surface, the upper surface descending in a direction away from the front surface of the drawer. The upper surface forms a manipulable surface, which may be pressed towards the drawer, resulting in rotation of the rotating bar. The upper surface may have grooves or protrusions. The grooves or protrusions may extend across to the end caps. The grooves or protrusions may enhance grip of the rotating bar. For example, the grooves or protrusions may allow for a user wearing heavy-duty gloves to have a firmer grip of the rotating bar. In another example, the grooves or protrusions may improve ease of sliding of the slides when the drawer contains heavy loads, for example a load of 600 lbs. The rotating bar may also include a generally flat vertical planar front surface. The front surface generally extends downward from a forward edge of the downward angled upper surface. The edge between the upper surface and the front surface may be rounded. The end caps 2521*a,b* are mounted to opposing side edges of the front panel of the drawer. In the embodiment of FIG. 25, the end caps are mounted at a height corresponding to locations of the drawer slides. The end caps of the embodiment of FIG. 25 form cavities with inner surfaces dimensioned so as to receive ends of the rotating bar, open to the front and inward sides. The inward sides of the cavities face each other, with opposing ends of the rotating bar in the channels of the opposing end caps. The rotating bar may be slightly spaced away from the front of the drawer.

The drawer slides, or at least one of them, includes a latch for latching the drawer slides in an unextended position. In the embodiment of FIG. 25, an outer member of the drawer slide includes a hook 2617 (see FIG. 26A) formed by a cutout in a forward edge of the web of the outer member, with the hook configured to capture a tab 2611 extending from the inner member. Rotation of the rotating bar 2519 releases the tab from the hook, thereby unlatching the latch, allowing for extension of the slides 2515 and opening of the drawer.

Figure 26A:
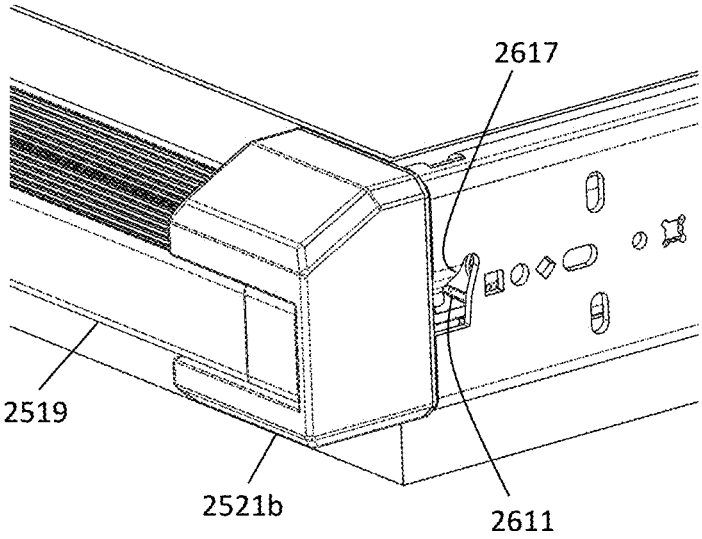
FIG. 26A is a partial perspective view of the drawer of FIG. 25, with the rotating bar in an unrotated position.

FIG. 26A is a partial perspective view of the drawer 2511, with the rotating bar 2519 in an unrotated position. The rotating bar 2519 is engageable with a release lever (see FIG. 29) with the release lever coupled to a tab 2611. The release lever is coupled to the tab 2611. In FIG. 26A, the tab 2611 is captured by a hook 2617 of the outer member. The tab extends in an inward direction from a web of the inner member, in turn, towards the outer member, with the slides in a retracted or closed position. The tab includes a ramped surface. On closing of the drawer slide, the ramped surface contacts the hook and partially rotates the release lever allowing the tab to pass under the hook 2617 of the outer member. The hook may be a bent over portion at the end of the forward end of the outer member. The release lever and tab are coupled to an inner member of the slide.

Figure 26B:
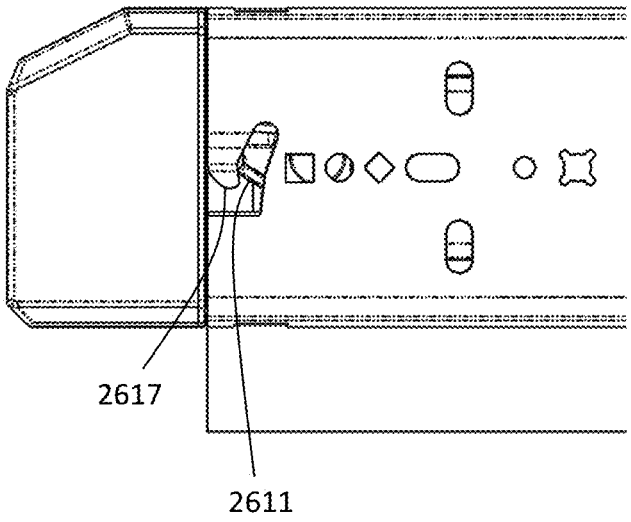
FIG. 26B is a side view of the drawer of FIG. 25, with the rotating bar in the unrotated position.

FIG. 26B is a side view of the drawer of FIG. 25, with the rotating bar in the unrotated position. In FIG. 26B, the tab 2611 extends out of the page, with the tab captured by the hook 2617.

Figure 27:
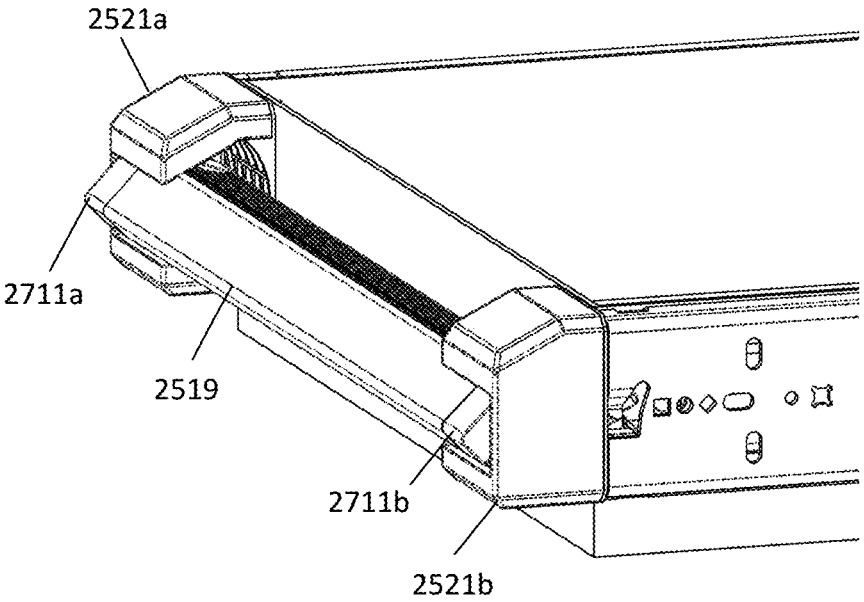
FIG. 27 is a partial perspective view of the drawer of FIG. 25, with the rotating bar in a rotated position.

FIG. 27 is a partial perspective view of the drawer 2511, with the rotating bar in a rotated position. The rotating bar may be rotated from the unrotated position to the rotated position by, for example, pressing down on a rearward portion of the rotating bar. In the rotated position, the rotating bar 2519 has a rear edge of its upper surface depressed downward, with the rear edge of the upper surface depressed downward, a lower edge of the forward surface extends outward, away from the drawer, with the bottom edge of ends of the rotating bar extending out through the open fronts of the end caps. In addition, FIG. 27 shows outer pieces 2711*a,b* coupled to opposing ends of the rotating bar. In the rotated position, the rotating bar, or more particularly an arm fixedly coupled to the rotating bar, depresses a release lever of the drawer slide, which unlatches the drawer slide. As discussed with respect to other embodiments, the release lever may instead be configured to be pressed upward to unlatch the drawer slide, or the drawer slide may be an unhanded drawer slide mounted in a reversed up/down manner.

Figure 28A:
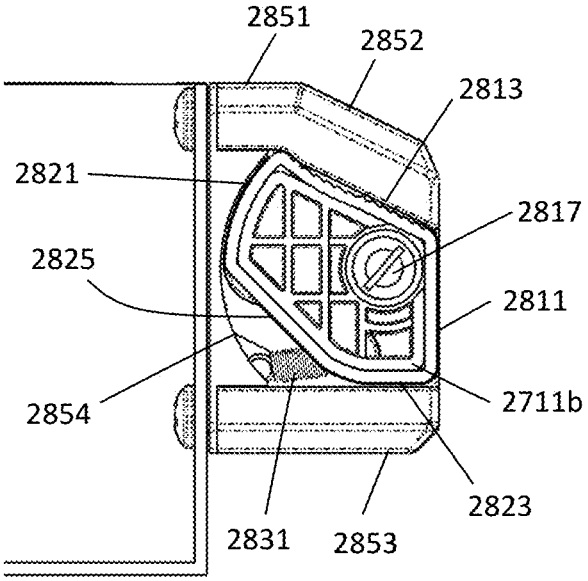
FIG. 28A is a section view inside an end cap of the drawer of FIG. 25, with the rotating bar in the unrotated position.

FIG. 28A is a section view showing the end cap 2521*b* of the drawer 2511, with the rotating bar 2519 in the unrotated position. The end cap may have an upper surface with a flat section 2851 parallel to a horizontal plane and a sloped section 2852 declining from a front edge of the flat section away from the front surface of the drawer. The edges of the flat section and the sloped section may be chamfered or filleted. The end cap may have a lower section 2853 spaced apart from and lower than the upper surface of the end cap with a lower surface of the lower section facing the ground. The lower section may have a width in a direction perpendicular to the front surface of the drawer. The width of the lower surface may be less than the width of the lower section.

The rotating bar is coupled to the outer piece 2711*b*. The outer piece is inset to outer surfaces of the rotating bar. A bolt 2817 is used to rotatably couple the outer piece (and hence the rotating bar) to the end cap. The bolt passes through an aperture of the outer piece, at a location just inset from the rounded edge coupling the upper surface 2813 and front surface 2811 of the rotating bar. The outer piece has a profile that closely follows the profile of the rotating bar. The rotating bar includes an upper surface 2813 with grooves etched thereon in a direction parallel to the front surface of the drawer. The upper surface of the rotating bar may be parallel to the sloped section of the upper surface of the end cap. The upper surface of the rotating bar may be lined up closely to the end cap. The upper surface of the rotating bar may approximately have the same width as the width of the sloped section of the upper surface of the end cap. The rotating bar also includes a lower surface 2823. The lower surface may be smooth. The lower surface of the rotating bar may be parallel to the lower section of the end cap. The lower surface of the rotating bar may be lined up closely to the end cap. The lower surface of the rotating bar may have a width less than the width of the lower section of the end cap. A sloped surface 2825 may extend upwardly at an angle from a rear edge of the lower surface. The rotating bar includes a curved section 2821 coupling a rearward edge of the sloped surface and a rear edge of the upper surface. The curved section may generally match curvature of a concave curved surface 2854 of a cover (see FIG. 32) attached to the rear end of the end cap. The matched curvature may serve to reduce introduction of debris between the rotating bar and the outer piece of the end cap.

The drawer 2511 includes a spring 2831 between the outer piece and the end cap which normally biases the rotating bar to the unrotated position by pulling the outer piece toward the rear of the end cap from the bottom. The spring requires a positive rotational force to rotate the rotating bar from the unrotated position.

Figure 28B:
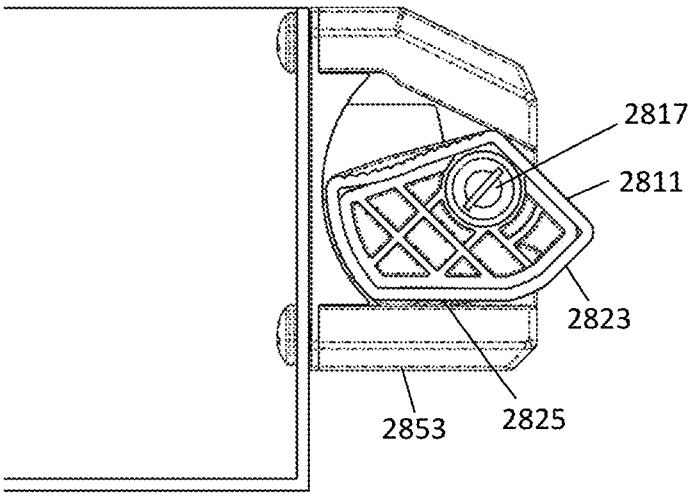
FIG. 28B is a section view inside the end cap of the drawer of FIG. 25, with the rotating bar in the rotated position.

FIG. 28B is a section view inside the end cap 2521*b* of the drawer 2511, with the rotating bar 2519 in the rotated position. The sloped surface 2825 of the rotating bar may be flush against the lower section 2853 of the end cap. Contact between the sloped surface and the lower section of the end cap may therefore provide a stop for rotation of the rotating bar. The lower surface 2823 of the rotating bar may be extending out of the end cap in a non-parallel direction to the ground. The front surface 2811 of the rotating bar may be partially extending out of the end cap in a non-parallel direction to the front surface of the drawer 2511.

Figure 29:
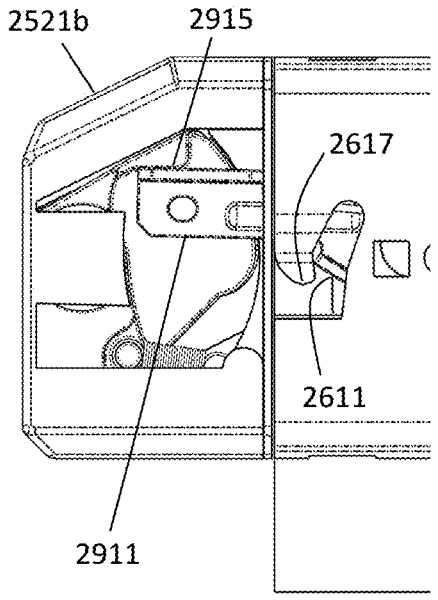
FIG. 29 is a cutaway view of the end cap of the drawer of FIG. 25, with the rotating bar in the unrotated position.

FIG. 29 is a cutaway view of the end cap 2521*b* of the drawer 2511, with the rotating bar 2519 in the unrotated position. The release lever 2911 may be coupled to an inner member of a drawer slide. An arm 2915 of the outer piece is above the release lever. Upper and lower surfaces of the release lever are approximately parallel to the ground in the unrotated position. The tab 2611 is coupled to the release lever, for example as discussed with respect to FIG. 5. The tab extends out of the page in FIG. 29, with the tab captured by the hook 2617, shaped out of the web of the outer member of the slide of the drawer. Rotation of the rotating bar results in rotation of the outer piece, with the arm of the outer piece depressing (or raising, depending on the embodiment) the release lever. Depression of the release lever results in a tab 2611 clearing the hook 2617, unlatching the drawer.

Figure 30:
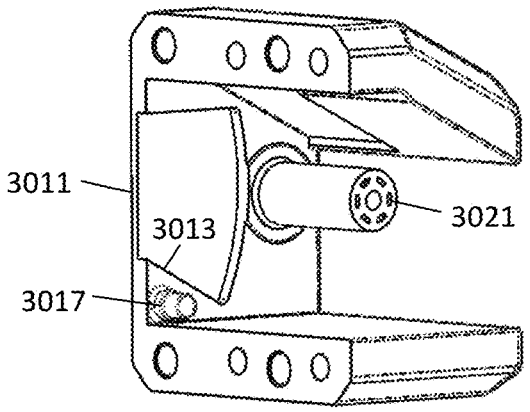
FIG. 30 is a perspective rear inside view of the end cap of the drawer of FIG. 25.

FIG. 30 is a perspective rear inside view of the end cap 2521*b* of the drawer 2511. As may be recalled, the end cap 2521*b* forms a cavity that allows for receipt of ends of the rotating bar, with the cavity open to the front and inward sides. A rear of the end cap may be covered, at least in part, by a cover, for example the cover of FIG. 32. A cylindrical support 3021, dimensioned to fit within the aperture 3121 (see FIGS. 31A,B) of the outer piece, extends from the bottom of the channel. As the bottom of the channel forms a side of the end cap, the cylindrical support extends towards the rotating bar when coupled to the end cap. As the cylindrical support fits within the aperture of the outer piece, the outer piece may be rotated about the cylindrical support.

A cutout 3011 is formed in the bottom of the channel forming the side of the end cap. The cutout may partially receive the release lever 2911 of the drawer slide 2515. The cutout is bounded by a lower surface 3013. In some embodiments the lower surface may provide a positive stop to motion of the release lever. In most embodiments, however, the cutout simply serves to provide additional room for movement of the release lever, allowing for increased dimensional tolerances for the release lever.

In addition, the end cap includes a pin 3017. The pin extends from the bottom of the channel, just below the stop surface 3013. The pin may be used for connecting a spring to the end cap. The spring may normally bias the outer piece and rotating bar to the unrotated position.

Figure 31A:
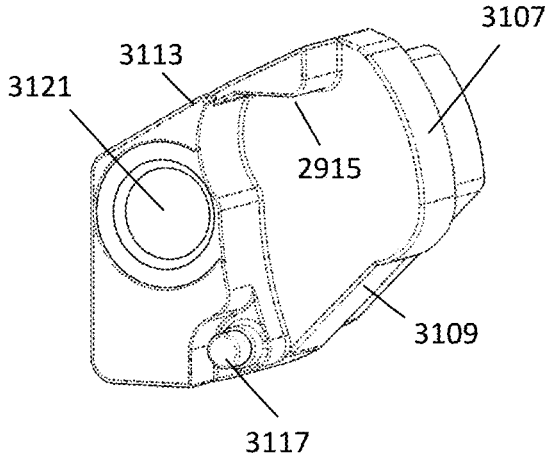
FIG. 31A is a perspective rear outer side view of an outer piece to be connected to the rotating bar of the drawer of FIG. 25.

FIG. 31A is a perspective rear outer side view of the outer piece to be connected to the rotating bar 2519 of the drawer 2511. In this regard, the outer view shows the side of the outer piece away from the rotating bar when the outer piece is mated with the rotating bar. The aperture 3121 is shown in proximity of the filleted front edge connecting the upper surface 3113 and the front surface 3105 (see FIG. 31B) of the outer piece.

Part of the upper surface also forms the arm 2915. The arm extends up to the rear edge connecting the upper surface and the curved surface 3107 of the outer piece. The rear edge may be chamfered or filleted. The arm may be used to engage with the release lever of a drawer slide. A pin 3117 is also formed in the outside of the outer piece. The pin is in proximity of the bottom surface of the outer piece, as the bottom surface approaches a sloped section 3109 of the rear surface of the outer piece. The pin may be used for connecting a spring to the outer piece, for example to normally bias the outer piece, and hence the rotating bar, to an unrotated position.

Figure 31B:
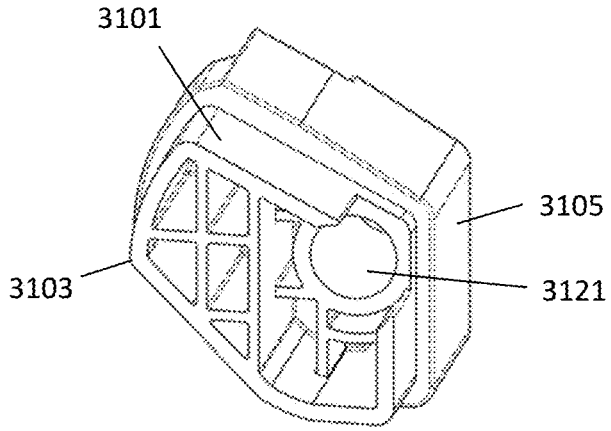
FIG. 31B is a perspective frontal inside side view of the outer piece to be connected to the rotating bar of the drawer of FIG. 25.

FIG. 31B is a perspective frontal inside side view of the outer piece to be connected to the rotating bar of the drawer. In this regard, the inside view shows the side of the outer piece that mates with the rotating bar. As such, the outer piece includes a fitting bounded by and upper surface 3101, a front surface, and a rear surface having a curved section and a sloped section connected by edge 3103. The edge 3103 may be filleted or chamfered. The fitting of the outer piece is dimensioned to correspond to and snugly fit within the portion of the rotating bar profile bounded by the upper surface 2813, front surface 2811, curved section 2821, and sloped section 2825, discussed with respect to FIGS. 28A,B. The fitting extends inward (towards the rotating bar when considering FIG. 31B) from a base. The base, on the inward side, includes the upper surface 3113, the front surface 3105, and the rear surface with the curved section 3107 and a sloped section 3109, all of which have dimensions corresponding to dimensions of the upper surface 2813, front surface 2811, curved section 2821, and sloped section 2825 of the rotating bar. A profile of the base of the outer piece therefore matches the profile of the rotating bar, with the fitting extending into an interior of the rotating bar. In addition, the outer piece includes the aperture 3121 extending through the fitting and the base proximate the front edge coupling the upper surface and the front surface. The aperture may receive a bolt, for example, to rotatably mount the outer piece to an end cap, as discussed for example with respect to FIGS. 28A,B.

Figure 32:
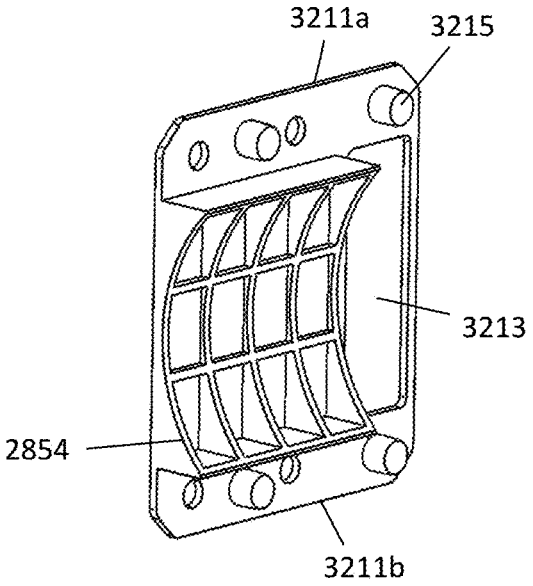
FIG. 32 is a perspective inside view of a cover for the end cap of the drawer of FIG. 25.

FIG. 32 is a perspective inside view of a rear cover for the end cap of the drawer. The cover has an upper surface 3211*a* and a lower surface 3211*b* that may be flush with the flat section 2851 of the upper surface of the end cap and a lower surface of the lower section 2853 of the end cap, respectively, when attached to the end cap. The cover may include an aperture 3213, through which the release lever may pass, with the aperture dimensioned so as to allow for operation of the release lever. The cover may be secured to the rear of the end cap. Hence, the cover may cover the rear opening of the channel formed by the end cap. The securement of the cover to the end cap may be facilitated by pins 3215 extending out of the cover. The pins may be received by holes on the rear of the end cap. There may be a top row of pins and a bottom row of pins, the top row being in proximity of the upper surface 3211*a* and the bottom row being in proximity of the lower surface 3211*b*. The cover may include a concave curved surface 2854 extending out of the cover. The concave curved surface may serve to prevent or reduce amounts of foreign object debris from entering into a volume of the end cap. In some embodiments there is some space between the concave curved surface and the a nearest surface of the outer piece and/or rotating bar, and the concave curved surface services to reduce size of foreign object debris that may enter the volume of the end cap.

Figure 33:
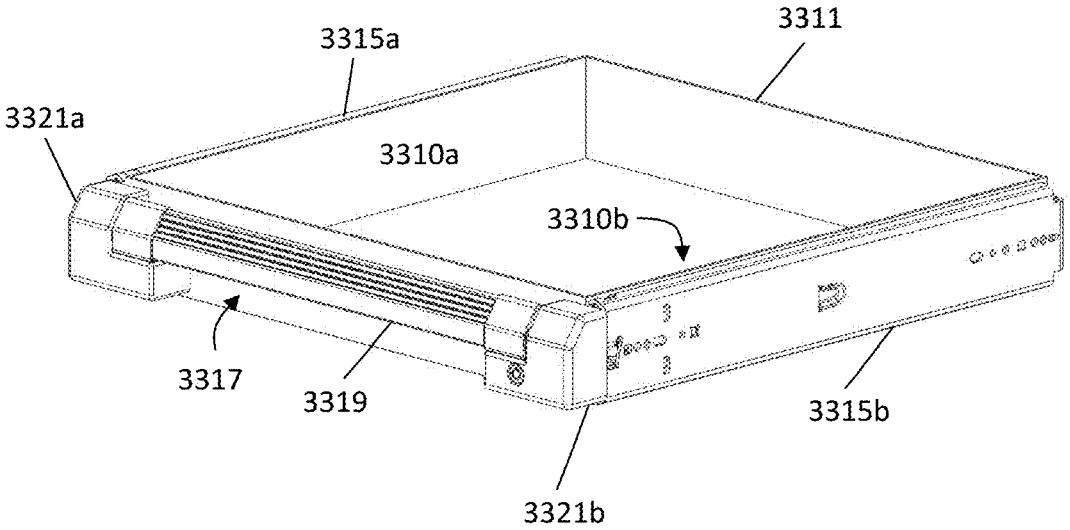
FIG. 33 is a perspective view of drawer with a drawer slide and a rotating bar for unlatching of the drawer slide, in accordance with aspects of the invention.

FIG. 33 is a perspective view of drawer with a drawer slide and a rotating bar for unlatching of the drawer slide. The drawer 3311 may be a drawer of a cabinet (not shown), with the cabinet generally including one or more drawers. The drawer of FIG. 33 is generally in the form of a rectangular box with an open top, allowing for access to contents of the drawer when the drawer is extended from the cabinet. In such a configuration, the drawer includes a drawer front panel 3317, a drawer rear panel in parallel to the drawer front, with longitudinal vertical edges of the drawer rear panel connected to the drawer front panel by a left side panel 3310*a* and a right side panel 3310*b*, in parallel.

Drawer slides 3315*a,b* are mounted to each of the side panels, from a rear to a forward end of the panels. The drawer slides include a plurality of members, extendable from one another. In some embodiments the drawer slides may be the drawer slides of FIGS. 5-7, or include various features of the drawer slide of FIGS. 5-7. The drawer slides are generally also mounted to a side of a frame of the cabinet or side walls of the cabinet, so that extension of the drawer slides allows the drawer to be extended from the cabinet, allowing access to the contents of the drawer.

A rotating bar 3319 is coupled between end caps 3321*a,b*. In the embodiment of FIG. 33, the rotating bar includes a downward angled upper surface, the upper surface descending in a direction away from the front surface of the drawer. The upper surface forms a manipulable surface, which may be pressed towards the drawer, resulting in rotation of the rotating bar. The upper surface may have grooves or protrusions. The grooves or protrusions may extend across to the end caps. The grooves or protrusions may enhance grip of the rotating bar. For example, the grooves or protrusions may allow for a user wearing heavy-duty gloves to have a firmer grip of the rotating bar. In another example, the grooves or protrusions may improve ease of sliding of the slides when the drawer contains heavy loads, for example a load of 600 lbs. The rotating bar may also include a generally flat vertical planar front surface. The front surface generally extends downward from a forward edge of the downward angled upper surface. The edge between the upper surface and the front surface may be rounded.

The end caps are mounted to opposing edges of the front panel of the drawer, with the end caps mounted at a height corresponding to locations of the drawer slides. The end caps of the embodiment of FIG. 33 are substantially L-shaped, when viewed from the front of the drawer, with inward-facing recesses facing each other and to receive the rotating bar. Vertical sides of the L-shaped recesses receive ends of the rotating bar, with the rotating bar spaced away from the front of the drawer.

The drawer slides, or at least one of them, includes a latch for latching the drawer slides in an unextended position. Rotation of the rotating bar unlatches the latch, allowing for extension of the slides and opening of the drawer.

Figure 34:
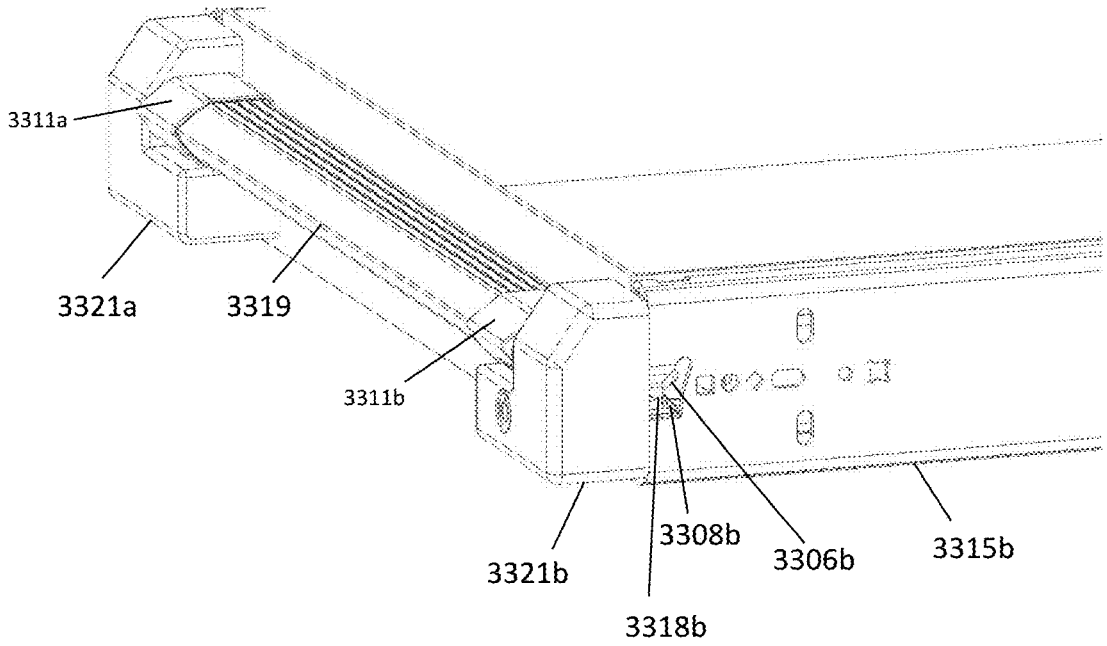
FIG. 34 is a partial perspective view of the drawer of FIG. 33, with the rotating bar in a rotated position, in accordance with aspects of the invention.

FIG. 34 is a partial perspective view of the drawer of FIG. 33, with the rotating bar in a rotated position. The rotating bar may be rotated from the unrotated position to the rotated position by, for example, pressing down on a rearward portion of the rotating bar. In the rotated position, the rotating bar 3319 has a rear edge of its upper surface depressed downward. With the rear edge of the upper surface depressed downward, a lower edge of the forward surface extends outward, away from the drawer, and slightly forward of the end caps 3321*a,b*. In the rotated position, the rotating bar, or more particularly an arm fixedly coupled to the rotating bar, depresses a release lever of the drawer slide, which unlatches the drawer slide. In the embodiment of FIGS. 33-34, the right-hand side release lever 3306*b* is partially visible through a cut-out in a forward end of an outer rail of the drawer slide. The cut-out forms a hook or catch 3318*b*, which normally catches a tab 3308*b* on a structure including the release lever, with the structure mounted, for example, to an inner rail of the drawer slide. Depression of the release lever allows the tab to clear the hook, allowing for extension of the inner rail of the drawer slide from the outer rail, and concomitant opening of the drawer. As discussed with respect to other embodiments, the release lever may instead be configured to be pressed upward to unlatch the drawer slide, or the drawer slide may be an unhanded drawer slide mounted in a reversed up/down manner.

In addition, FIG. 34 shows end sheathes 3311*a,b* on opposing ends of the rotating bar. With the rotating bar in an unrotated position, for example as viewed in FIG. 33, forward surfaces of the end sheathes are substantially aligned with forward surfaces of the end stops, in the embodiment of FIG. 33-34. Use of the end sheathes may be beneficial for a variety of reasons, including prevention or reduction of foreign objects from entering an interior of the rotating bar, in the event the rotating bar is hollow.

Figure 35:
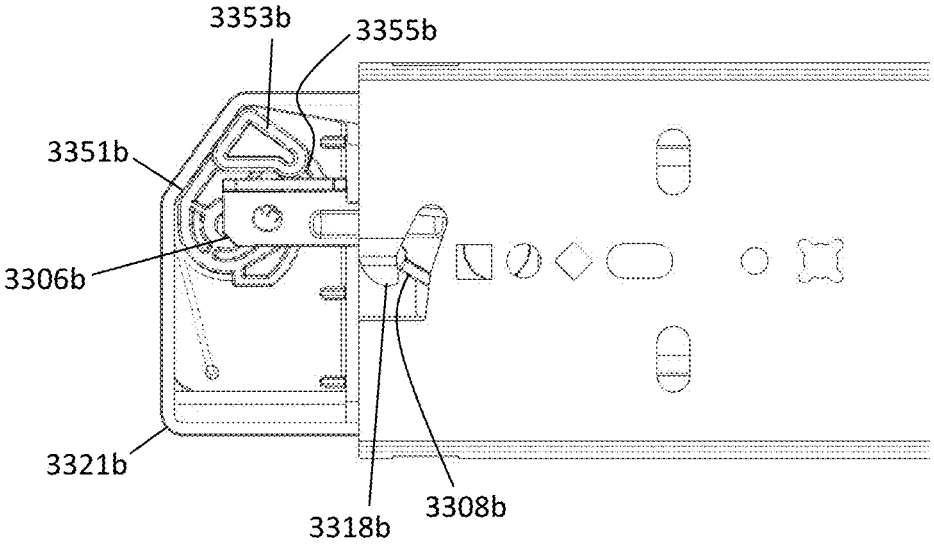
FIG. 35 is a side view of a front end of the embodiment of FIG. 33, with a section view inside the right-hand side end cap, and the rotating bar in the unrotated position, in accordance with aspects of the invention.

FIG. 35 is a side view of a front end of the embodiment of FIG. 33, with a section view inside the right-hand side end cap 3321*b*, and the rotating bar in the unrotated position. An outer piece 3351*b* is fixedly coupled to the rotating bar. The outer piece includes an extending arm 3353*b*. In the embodiment of FIG. 35, the extending arm has a roughly triangular cross-section. An end of the arm closest to the face of the drawer includes a slightly bulbous tip 3353*b*. The arm of the outer piece is over a forward end of a release lever 3306*b* of the drawer slide. The outer piece and the arm, which is part of the outer piece, are rotatable with the rotatable bar. The arm and a forward portion of the release lever are within a volume defined by the end cap 3321*b*. The release lever may be coupled to an inner member of a drawer slide, as previously discussed. A tab 3308*b* is part of the same structure as the release lever. With the rotatable bar in the unrotated position, a tab is constrained from forward motion by a hook 3318*b* formed in a forward end of the outer slide member.

Figure 36:
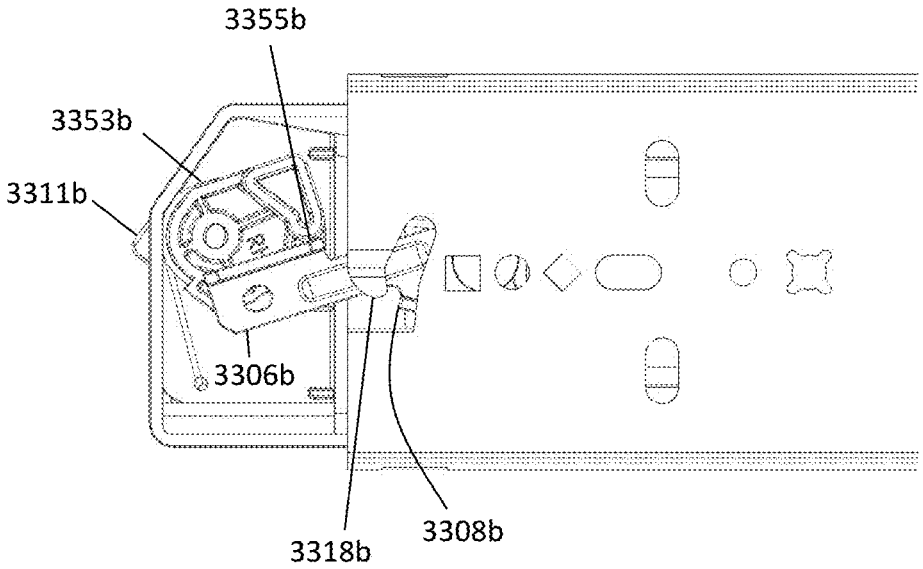
FIG. 36 is a further side view of a front end of the embodiment of FIG. 33, with a section view inside the right-hand side end cap, and the rotating bar in the rotated position, in accordance with aspects of the invention.

FIG. 36 is a further side view of a front end of the embodiment of FIG. 33, with a section view inside the right-hand side end cap 3321*b*, and the rotating bar 3311*b* in the rotated position. In the rotated position, the arm of the outer piece 3353*b*, particularly the bulbous tip 3355*b*, has depressed the release lever 3306*b*. Depression of the release lever also results in depression of the tab 3308*b*, such that the tab clears the hook 3318, thereby unlatching the latch of the drawer slide to which the release lever is attached.

Figure 37:
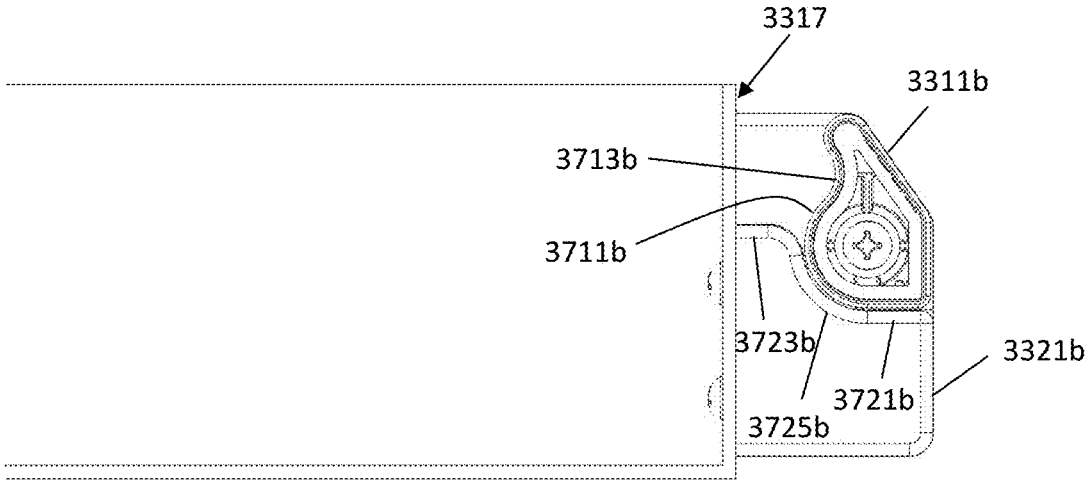
FIG. 37 is a side section view showing the end cap, with the rotating bar in the unrotated position, in accordance with aspects of the invention.

FIG. 37 is a side section view showing the end cap 3321*b*, with the rotating bar in the unrotated position. The end cap is shown mounted to a front panel 3317 of a drawer. The rotating bar is on a top of a bottom of portion of the end cap. The top of the bottom portion of the end cap is an exterior surface of the end cap. In the embodiment of FIG. 37, the top of the bottom portion of the end cap is a smooth continuous surface, with no discontinuities. A top of the bottom portion of the end cap has an upper surface with two generally flat surfaces 3721*b*, 3723*b* offset vertically from one another, with the flat surfaces linked by a curved surface 3725*b*. The flat surface 3721*b* is towards a forward edge of the end cap, away from the drawer front panel. The flat surface 3723*b* is towards a rear edge of the end cap, adjacent the drawer front panel. The curved surface links the two flat surfaces, with the curved surface being concave, with a rounded edge connecting the flat surface 3723*b* and the curved surface. The rounded edge may also be considered a convex curve in the top of the bottom portion of the end cap.

An end sheath 3311*b* is formed over and tightly covers an end of the rotating bar. For purposes of this portion of the description the end sheath may be considered to be part of the rotating bar. In the embodiment of FIG. 37, surfaces of the end sheath, or rotating bar in the absence of an end sheath, that face or engage with the top of the bottom portion of the end caps are smooth and continuous surfaces, without discontinuities. A bottom surface of the rotating bar has a forward flat portion, followed by an arcuate convex portion 3711*b* extending generally upwards and towards the drawer front panel, which flows into a concave curved portion 3713*b*. The arcuate convex portion is substantially dimensioned so as to be rotatable within the concave curved surface of the end stop. The concave curved portion extends generally upward, with the rotating bar in the unrotated position. Curvature of the arcuate convex portion of the rotating bar matches the curvature of the curved surface 3725*b* of the top of the bottom portion of the end cap. Curvature and length of the concave curved portion of the rotating bar match curvature and length of the rounded edge of the end cap.

Figure 38:
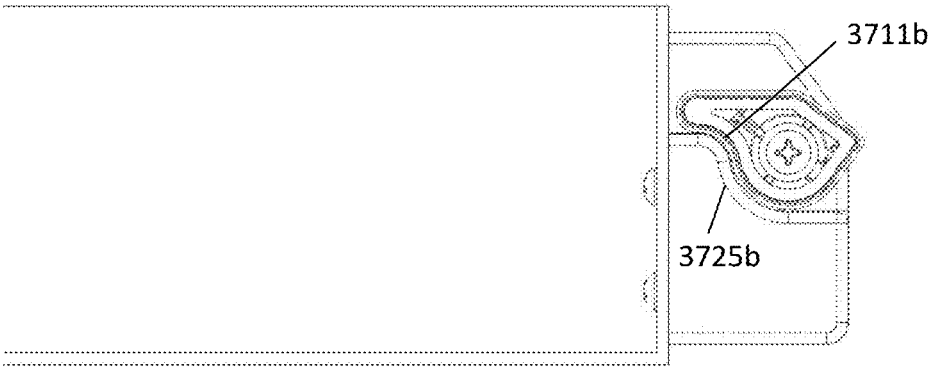
FIG. 38 is a sectioned side view showing the end cap, with the rotating bar in the unrotated position, in accordance with aspects of the invention.

FIG. 38 is a sectioned side view showing the end cap 3321*b*, with the rotating bar in the rotated position. In FIG. 38, the concave curved portion is substantially engaged with the rounded edge of the top of the bottom surface of the end cap, with he rounded edge of the top of the bottom surface of the end cap preventing further rotation of the rotating bar. The rounded edge of the top of the bottom surface of the end cap therefore serves as a rotational stop for rotation of the rotating bar. In some embodiments the rotating bar may be shaped such that the upper flat surface of the top of the bottom surface of the end cap instead or in addition serves as the rotation stop for rotation of the rotating bar.

Figure 39:
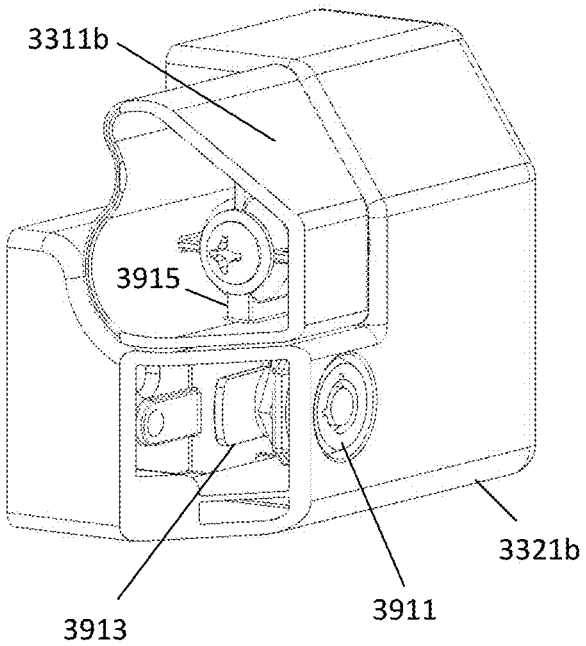
FIG. 39 is a perspective partially cut-away view of the right-hand side end cap and end sheath for the rotating bar, illustrating a locking mechanism for the rotating bar, in accordance with aspects of the invention.

FIG. 39 is a perspective partially cut-away view of the right-hand side end cap and end sheath for the rotating bar, illustrating a locking mechanism for the rotating bar. In FIG. 39, the end sheath 3311*b* is shown mounted in recess of the endcap 3321*b*. A bolt passes through an end of the sheath and through an interior sidewall of the end cap, so as to rotatably mount the end sheath (and rotating bar, when present) to the end cap. A lock mechanism has a keyhole 3911 accessible on a front of the end cap, below the end sheath. A cut-away portion of the end cap shows a tab 3913 within the end cap, with the tab mounted to a cylinder of the lock mechanism. The tab in FIG. 39 shows the lock mechanism in an unlocked state. The tab is substantially under a cavity formed in a bottom side of the end sheath, under a position of the bolt passing through the end of the sheath. In FIG. 39, external walls of the cavity 3915 may be seen descending from about a position of the bolt.

Figure 40:
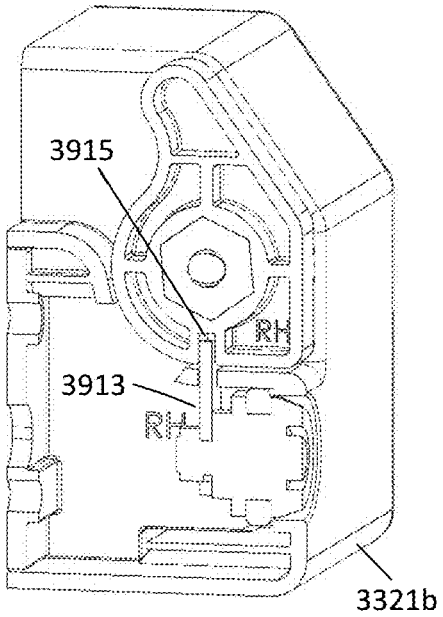
FIG. 40 is a cross sectional side view of the end cap and end sheath, again with the rotating bar in the unrotated position, in accordance with aspects of the invention.

FIG. 40 is a cross sectional side view of the end cap 3321*b* and end sheath, again with the rotating bar in the unrotated position. In FIG. 40, the lock mechanism is in a locked state, with the tab 3913 rotated into the cavity 3915 of the end sheath. The cavity forms a slot in the end sheath. With the tab in the slot, contact between the tab and forward and rearward walls of the slot prevents rotation of the end sheath, and thus prevent rotation of the rotating bar.

Figure 41:
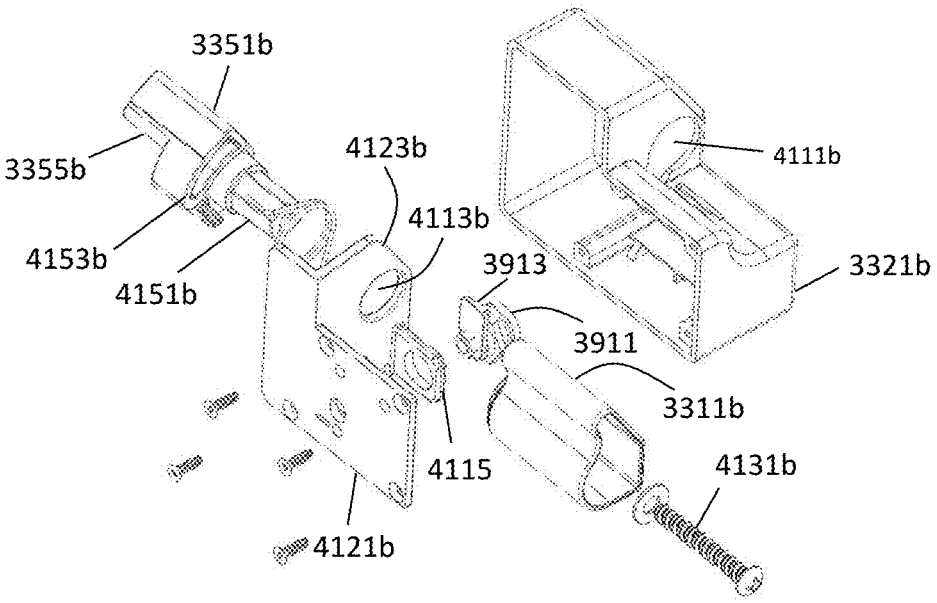
FIG. 41 is an exploded view of an end cap and associated parts, in accordance with aspects of the invention.

FIG. 41 is an exploded view of an end cap and associated parts. The end cap 3321 includes a ledge upon which sits the end sheath 3311*b* for the rotating bar. A vertical side wall extending above the ledge includes an aperture 4111*b* for passage of a bolt 4131*b*, which extends through an interior of the end sheath. The aperture is sized to receive a corresponding lip on the end of the end sheath.

The end cap is fitted over a mounting bracket 4121*b*. In some embodiments the end cap may be compression fitted over the mounting bracket, in some embodiments the end cap may be affixed to the mounting bracket by screws. The mounting bracket has a T-shape, with a base plate that may be affixed to a front panel of a drawer, for example using screws. An extending plate 4123*b* extends from the base plate and includes an aperture for passage of the bolt and, in some embodiments, to receive the lip of the end sheath. The outer piece 3355*b*, including the extending arm which terminates in the bulbous tip 3355*b*, is positioned on an opposing side of the extending plate. The outer piece includes a hexagonal key 4151*b* that also may be fitted through the aperture in the extending plate, and through a corresponding aperture or into a corresponding cavity in the end of the end sheath. In various embodiments other keying structures may be used to maintain relative position of the outer piece and the end sheath and rotating bar. For example, in some embodiments the key may have a circular cross-section, with a single radial protrusion, with the corresponding aperture or slot of the end sheath having a similar or same shape. The hexagonal key may receive the bolt, such that the outer piece and the end sheath are mounted to each other. A spring biases the outer piece, and by extension the end sheath and rotating arm, to an unrotated position.

A further apertured tab extends about a forward edge of the extending plate, with the apertured tab parallel to the base plate. The apertured tab receives a cylinder of the lock mechanism.

The outer piece also includes a radial slot 4153*b*. The radial slot faces towards the extending plate 4123*b*, and is positioned to receive a projection, for example in the form of a nub or lance, extending from the extending plate. The radial slot is positioned, and has a length, such that opposing ends of the radial slot contact the nub with the rotating bar in the rotated and unrotated positions, respectively. The radial slot and nub, therefore, serve as rotational stops for the rotating bar at the rotated and unrotated positions. In some embodiments the radial slot and nub may serve as the rotational stops for the rotating bar, with the end cap not used for the purpose of providing rotational stops. Considering that the lock is also mounted to the further apertured tab extending from the extending plate, the use of the mounting bracket with a rotational stop element may allow for operation of the device without impairment of operational functions even if the end caps are damaged or removed, although protection against foreign object debris may be reduced.

Figure 42:
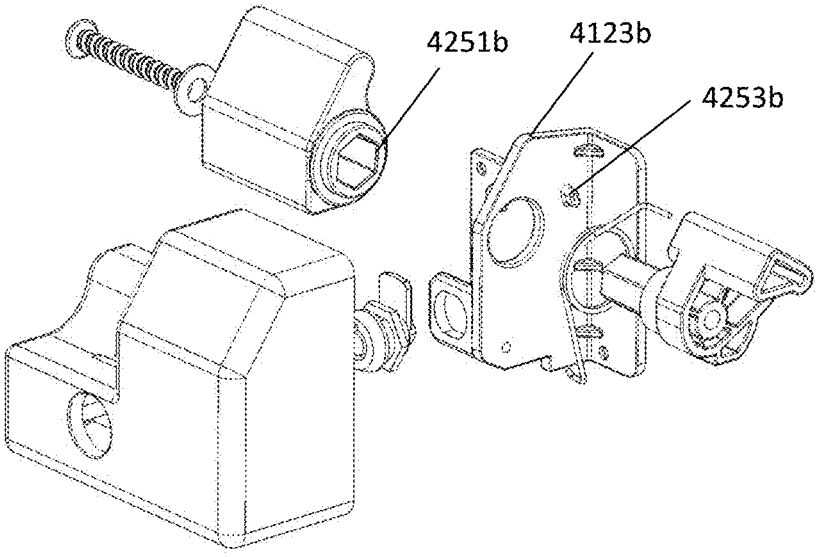
FIG. 42 is an opposing exploded view of the end cap and associated parts of FIG. 41, in accordance with aspects of the invention.

FIG. 42 is an opposing exploded view of the end cap and associated parts of FIG. 41. FIG. 42 shows the aperture 4251*b* for receiving the hexagonal key of the outer piece. FIG. 41 also shows the nub 4253*b* on the extending plate 4123*b* of the mounting plate. The nub is dimensioned to fit into the radial slot of the outer piece, with the nub and radial slot providing rotational stops for the outer piece, and therefore the rotating bar.

Although the invention has been discussed with respect to various embodiments, it should be recognized that the invention comprises the novel and non-obvious claims supported by this disclosure.

What is claimed is:

1. A drawer slide latch and release mechanism, comprising:

a release lever pivotably mounted to a web of an inner member of a drawer slide, the release lever being part of a structure including a tab for engagement in a catch of an outer member of the drawer slide, the tab of the structure including the release lever positionable within the catch with the release lever in a first position, and the tab of the structure including the release lever positioned free of the catch with the release lever in a second position, different than the first position; and a rotating bar coupled to an arm, the rotating bar including a manipulable surface for use in displacing the manipulable surface towards a drawer to which the drawer slide is to be mounted, to cause rotation of the rotating bar, the arm positioned to engage the release lever on rotation of the rotating bar so as to move the release lever to the second position.

2. The drawer slide latch and release mechanism of claim 1, wherein the arm is coupled to the rotating bar so as to rotate with the rotating bar, with the arm dimensioned to contact the release lever on rotation of the rotating bar.

3. The drawer slide latch and release mechanism of claim 1, wherein the catch is formed of a cutout in a web of the outer member.

4. The drawer slide latch and release mechanism of claim 1, wherein the rotating bar is mounted horizontally within end caps.

5. The drawer slide latch and release mechanism of claim 4, wherein the arm is within a volume defined by one of the end caps.

6. The drawer slide latch and release mechanism of claim 5, wherein the release lever extends into the volume defined by the one of the end caps.

7. The drawer slide latch and release mechanism of claim 6, wherein the arm is fixedly coupled to the rotating bar.

8. The drawer slide latch and release mechanism of claim 4, wherein at least one of the end caps includes an exterior surface that serves as a rotational stop for the rotating bar.

9. The drawer slide latch and release mechanism of claim 8, wherein the exterior surface of the end cap that serves as the rotational stop for the rotating bar includes a rounded or curved portion.

10. The drawer slide latch and release mechanism of claim 9, wherein the exterior surface of the end cap that serves as the rotational stop for the rotating bar includes a convex curved surface.

11. The drawer slide latch and release mechanism of claim 8, wherein the exterior surface of the end cap that serves as the rotational stop for the rotating bar is a continuous surface.

12. The drawer slide latch and release mechanism of claim 11, wherein the rotational stop is a rotational stop for the rotating bar when the release lever is in the second position.

13. The drawer slide latch and release mechanism of claim 5, wherein the rotating bar is coupled to a further arm, the further arm positioned to contact an interior surface of the one of the end caps such that the interior surface of the one of the end caps serves as a rotational stop for the rotating bar.

14. The drawer slide latch and release mechanism of claim 2, wherein the arm is on an outer piece fixed in position with respect to the rotating bar.

15. The drawer slide latch and release mechanism of claim 14, further comprising a mounting plate affixable to a front of the drawer, the mounting plate including an extending plate having a projection on one side, and wherein the outer piece includes a radial slot dimensioned to receive at least a portion of the projection, with ends of the radial slot positioned so that contact between the projection and the ends of the radial slot serve as rotational stops for the rotating bar.

* * * * *